US009336742B2

(12) United States Patent
Ahn et al.

(10) Patent No.: US 9,336,742 B2
(45) Date of Patent: May 10, 2016

(54) DISPLAY DEVICE AND DRIVING METHOD THEREOF

(71) Applicant: Samsung Display Co., Ltd., Yongin, Gyeonggi-Do (KR)

(72) Inventors: Ik Hyun Ahn, Hwaseong-si (KR); Yoon Gu Kim, Seoul (KR); Bong Im Park, Asan-si (KR); Seon Ki Kim, Anyang-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 114 days.

(21) Appl. No.: 14/095,821

(22) Filed: Dec. 3, 2013

(65) Prior Publication Data

US 2015/0022512 A1 Jan. 22, 2015

(30) Foreign Application Priority Data

Jul. 18, 2013 (KR) ..... 10-2013-0084946

(51) Int. Cl.
*G09G 3/36* (2006.01)

(52) U.S. Cl.
CPC ..... *G09G 3/3696* (2013.01); *G09G 3/3607* (2013.01); *G09G 3/3659* (2013.01); *G09G 3/3614* (2013.01); *G09G 2320/0233* (2013.01); *G09G 2320/0285* (2013.01); *G09G 2320/103* (2013.01); *G09G 2340/0435* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,407,729 | B1 | 6/2002 | Moon | |
| 7,151,519 | B2 | 12/2006 | Lee | |
| 8,139,052 | B2 | 3/2012 | Ito | |
| 8,354,988 | B2 | 1/2013 | Kim et al. | |
| 2005/0041488 | A1 | 2/2005 | Ito et al. | |
| 2007/0013636 | A1 * | 1/2007 | Lee | G09G 3/3648 345/98 |
| 2007/0139339 | A1 | 6/2007 | Kim et al. | |
| 2007/0296741 | A1 * | 12/2007 | Park | G09G 3/2003 345/690 |
| 2010/0013802 | A1 | 1/2010 | Hosaka et al. | |
| 2010/0060554 | A1 * | 3/2010 | Koh | G09G 3/3225 345/77 |
| 2011/0109662 | A1 * | 5/2011 | Cho | G09G 3/3688 345/690 |
| 2012/0147025 | A1 * | 6/2012 | Pyo | H04N 5/57 345/581 |
| 2014/0253603 | A1 * | 9/2014 | Kwon | G09G 3/3208 345/690 |
| 2014/0320521 | A1 * | 10/2014 | Oh | G09G 5/02 345/601 |
| 2015/0194119 | A1 * | 7/2015 | Ahn | G09G 3/3696 345/213 |

FOREIGN PATENT DOCUMENTS

| | | |
|---|---|---|
| JP | 3882795 (B2) | 11/2006 |
| JP | 2008-058509 (A) | 3/2008 |
| JP | 5098619 (B2) | 10/2012 |

(Continued)

*Primary Examiner* — Van Chow
(74) *Attorney, Agent, or Firm* — Knobbe, Martens, Olson & Bear, LLP

(57) ABSTRACT

A display device and a driving method thereof are disclosed. In one aspect, the display device includes a display panel including a plurality of pixel rows, a data driver configured to transfer data voltages to the display panel, a gate driver configured to transfer gate signals to the display panel, and a signal controller configured to control the data driver and the gate driver. The pixel rows are divided into i (i is a natural number of 2 or more) pixel row groups including a plurality of pixel rows, respectively. The display panel displays one still image for one frame set including the i sequential frames, and each of the i pixel row groups is charged by receiving the data voltage for each frame of the frame set, and the frames in which the i pixel row groups are charged are different from each other.

21 Claims, 39 Drawing Sheets

(56) References Cited

FOREIGN PATENT DOCUMENTS

| | | |
|---|---|---|
| KR | 10-2006-0018393 (A) | 3/2006 |
| KR | 10-2008-0048655 (A) | 6/2008 |
| KR | 10-2009-0061458 (A) | 6/2009 |
| KR | 10-2010-0073739 (A) | 7/2010 |
| KR | 10-2014-0078231 (A) | 6/2014 |

* cited by examiner

Still Image(Odd Frame)

FIG.35

Still Image((3N-1)th Frame)

| |
|---|
| 1 line : Charging |
| 2 line : Hold |
| 3 line : Hold |
| 4 line : Charging |
| 5 line : Hold |
| 6 line : Hold |
| 7 line : Charging |

⋮

| |
|---|
| (k-3) line : Hold |
| (k-2) line : Charging |
| (k-1) line : Hold |
| k line : Hold |

FIG.36

Still Image(3Nth Frame)

| |
|---|
| 1 line : Hold |
| 2 line : Charging |
| 3 line : Hold |
| 4 line : Hold |
| 5 line : Charging |
| 6 line : Hold |
| 7 line : Hold |

⋮

| |
|---|
| (k-3) line : Hold |
| (k-2) line : Hold |
| (k-1) line : Charging |
| k line : Hold |

FIG.37

Still Image((3N+1)th Frame)

| |
|---|
| 1 line : Hold |
| 2 line : Hold |
| 3 line : Charging |
| 4 line : Hold |
| 5 line : Hold |
| 6 line : Charging |
| 7 line : Hold |

⋮

| |
|---|
| (k-3) line : Charging |
| (k-2) line : Hold |
| (k-1) line : Hold |
| k line : Charging |

DISPLAY DEVICE AND DRIVING METHOD THEREOF

CROSS-REFERENCE TO RELATED APPLICATIONS

This application claims priority to and the benefit of Korean Patent Application No. 10-2013-0084946 filed in the Korean Intellectual Property Office on Jul. 18, 2013, the entire contents of which are incorporated herein by reference.

BACKGROUND

1. Field

The described technology generally relates to a display device and a driving method thereof.

2. Description of the Related Technology

Display devices such as liquid crystal displays (LCDs) and organic light-emitting diode (OLED) displays generally include a display panel and a driving device for driving the display panel.

Display panels generally include a plurality of signal lines and a plurality of pixels connected to the signal lines and arranged in a substantially matrix form.

The signal lines typically include a plurality of gate lines transferring gate signals and a plurality of data lines transferring data voltages.

Each pixel typically includes at least one switching element connected to the corresponding gate and data lines, at least one pixel electrode connected to the switching element, and an opposing electrode facing the pixel electrode and receiving a common voltage. The switching element typically includes at least one thin film transistor and the switching element is typically turned on or off according to a gate signal received from the gate line to selectively transfer the data voltage received from the data line to the pixel electrode. Each pixel typically displays an image at a luminance according to the difference between the data voltage applied to the pixel electrode and the common voltage.

Images displayed by the display device are generally classified into still images and moving images. Generally, when image signals of adjacent frames are substantially the same as each other, a still image is displayed, and when the image signals of adjacent frames are different from each other, a moving image is displayed.

Generally, the driving device includes a graphic processing unit (GPU), a driver, and a signal controller controlling the driver. The graphic processing unit generally transmits an input image signal for an image to be displayed on the display panel to the signal controller and the signal controller generates a control signal for driving the display panel. Generally, the signal controller transmits the control signal to the driver together with the image signal. The driver generally includes a gate driver generating a gate signal and a data driver generating a data voltage.

The above information disclosed in this Background section is only intended to facilitate the understanding of the background of the described technology and therefore it may contain information that does not constitute the prior art that is already known in this country to a person of ordinary skill in the art.

SUMMARY OF CERTAIN INVENTIVE ASPECTS

One inventive aspect is a display device and a driving method thereof having the advantages of substantially preventing charging-type stains from being generated by compensating for a charging ratio of the display device.

Another aspect is a display device and a driving method thereof having the advantages of reducing power consumption by reducing the heat generated in the data driver.

Another aspect is a display device and a driving method thereof having the advantages of substantially preventing flicker from occurring when the display device displays a still image.

Another aspect is a display device, including a display panel including a plurality of pixels, a data driver configured to transfer data voltages to a plurality of data lines, a gate driver configured to transfer gate signals to a plurality of gate lines, and a signal controller configured to control the data driver and the gate driver, in which the signal controller includes a plurality of lookup tables corresponding to different pixel positions in the display panel. The lookup table stores a correction value of a first input image signal of a first pixel, and the correction value is a value depending on the first input image signal and a second input image signal, the second input image signal is an input image signal for a second pixel charged before the first pixel is charged by a data voltage of a first data line to which the first pixel is connected, and the signal controller compensates for the first input image signal by using the correction value.

Another aspect is a display device, including a display panel including a plurality of pixels, a data driver configured to transfer data voltages to a plurality of data lines, a gate driver configured to transfer gate signals to a plurality of gate lines, and a signal controller configured to control the data driver and the gate driver, in which the signal controller includes a lookup table storing a correction ratio depending on pixel positions in the display panel. The data driver receives an output image signal and a first correction ratio corresponding to the output image signal from the signal controller, and compensates for the output image signal by using the first correction ratio to generate a compensated output image signal.

Another aspect is a display device, including a display panel including a plurality of pixels, a data driver configured to transfer a data signal to the display panel, a gate driver configured to transfer a gate signal to the display panel, and a signal controller configured to control the data driver and the gate driver, wherein the plurality of pixels are divided into a plurality of pixel row groups respectively including a plurality of pixel rows. The display panel displays a still image for a frame set including sequential frames, the number of sequential frames being the same as the number of pixel row groups, and the plurality of pixel row groups are respectively charged with the data voltage for a corresponding frame of the frame set which are different from each other for the plurality of pixel row groups.

Another aspect is a method of driving a display device, the display device including a signal controller, the signal controller including a plurality of lookup tables corresponding to different pixel positions in a display panel including a plurality of pixels, the method including receiving a first input image signal for a first pixel, obtaining a correction value for the first input image signal from the lookup table by using the first input image signal and a second input image signal, and compensating for the first input image signal by using the correction value. The second input image signal is an input image signal for a second pixel charged before the first pixel is charged by a data voltage of a first data line to which the first pixel is connected.

Another aspect is a method of driving a display device, the display device including a data driver and a lookup table storing correction ratios depending on pixel positions in a display panel including a plurality of pixels, the method including receiving a first input image signal for a first pixel, obtaining a first correction ratio corresponding to the first input image signal from the lookup table, processing the first input image signal to generate an output image signal, outputting the output image signal and the first correction ratio to the data driver, and compensating for the output image signal by using the first correction ratio to generate a compensated output image signal.

Another aspect is a method of driving display device including a display panel, including transferring data voltages for a still image to the display panel including a plurality of pixels for one frame set including a plurality of sequential frames, transferring gate signals to the display panel for the frame set, dividing the plurality of pixels into a plurality of pixel row groups respectively including a plurality of pixel rows, and charging each of the plurality of pixel row groups to the data voltage for a corresponding frame.

According to at least one embodiment, it is possible to substantially prevent charging-type stains from being generated by compensating for a charging ratio of the display device and reduce power consumption by reducing the heat generated in the driver. Further, it is possible to substantially prevent flicker from occurring when the display device displays a still image.

BRIEF DESCRIPTION OF THE DRAWINGS

FIG. 35 is a diagram illustrating a pixel row charged in a (3N−1)-th frame (N is a natural number) when a still image is displayed on the display device according to the exemplary embodiment.

FIG. 36 is a diagram illustrating a pixel row charged in a 3N-th frame (N is a natural number) when a still image is displayed on the display device according to the exemplary embodiment.

FIG. 37 is a diagram illustrating a pixel row charged in a (3N+1)-th frame (N is a natural number) when a still image is displayed on the display device according to the exemplary embodiment.

DETAILED DESCRIPTION OF CERTAIN INVENTIVE EMBODIMENTS

As display resolution increases, the time available for each pixel to be charged to a target data voltage is shortened, and as a result, the charging ratio of each pixel decreases and charging-type stains may be generated. Particularly, when inverting the polarity of the data voltage, the time available to charge the data voltage to a target data voltage can be insufficient, and as a result, the charging ratio of each pixel may decrease. Further, as the number of frames displayed per second in a display device, that is, the frame frequency increases, the charging ratio of the pixel may further decreases.

The described technology will be described more fully hereinafter with reference to the accompanying drawings, in which exemplary embodiments of the described technology are shown. As those skilled in the art would realize, the described embodiments may be modified in various different ways, all without departing from the spirit or scope of the described technology.

Hereinafter, a display device and a driving method thereof according to an exemplary embodiment of the described technology will be described in detail with reference to the accompanying drawings.

First, a display device according to an exemplary embodiment of the described technology will be described with reference to FIGS. 1 to 5.

Figure 1:
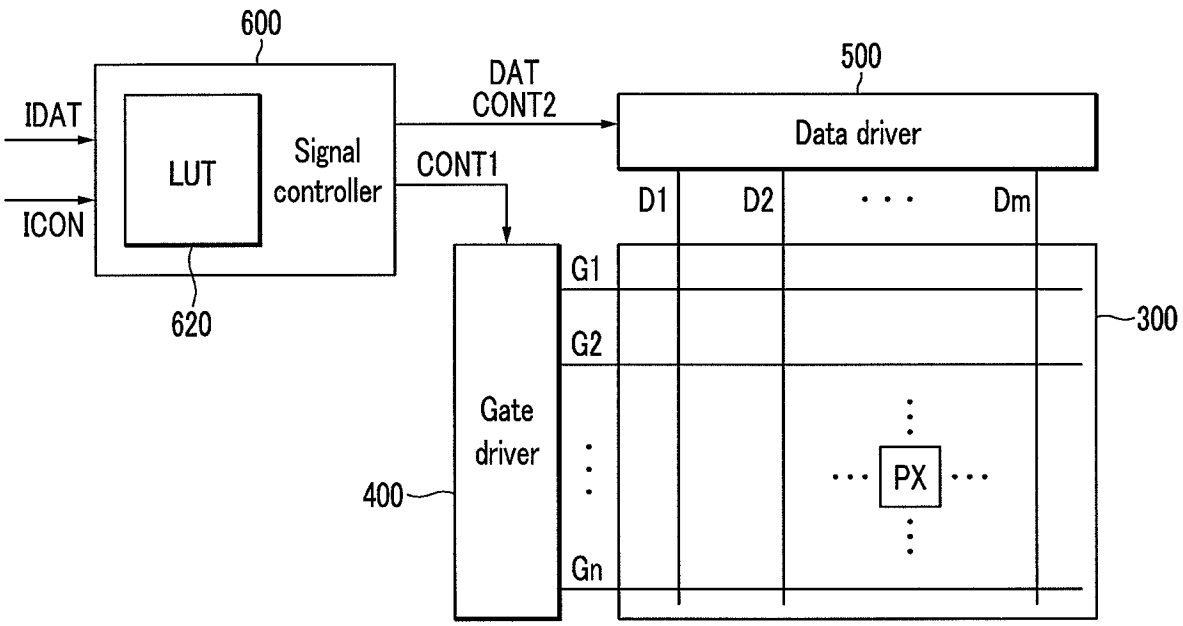
FIG. 1 is a block diagram of a display device according to an exemplary embodiment.
Figure 2:
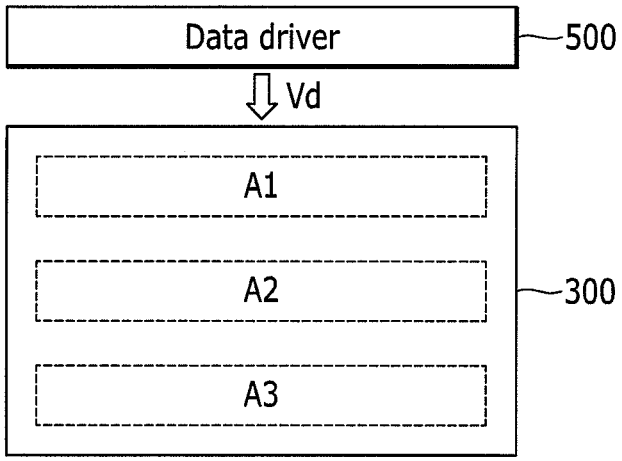
FIG. 2 is a block diagram of a display panel and a data driver of the display device according to the exemplary embodiment.
Figure 3:
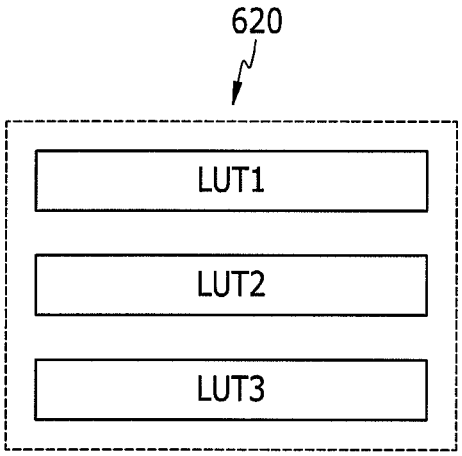
FIG. 3 is a block diagram of a lookup table included in a signal controller of the display device according to the exemplary embodiment.
Figure 4:
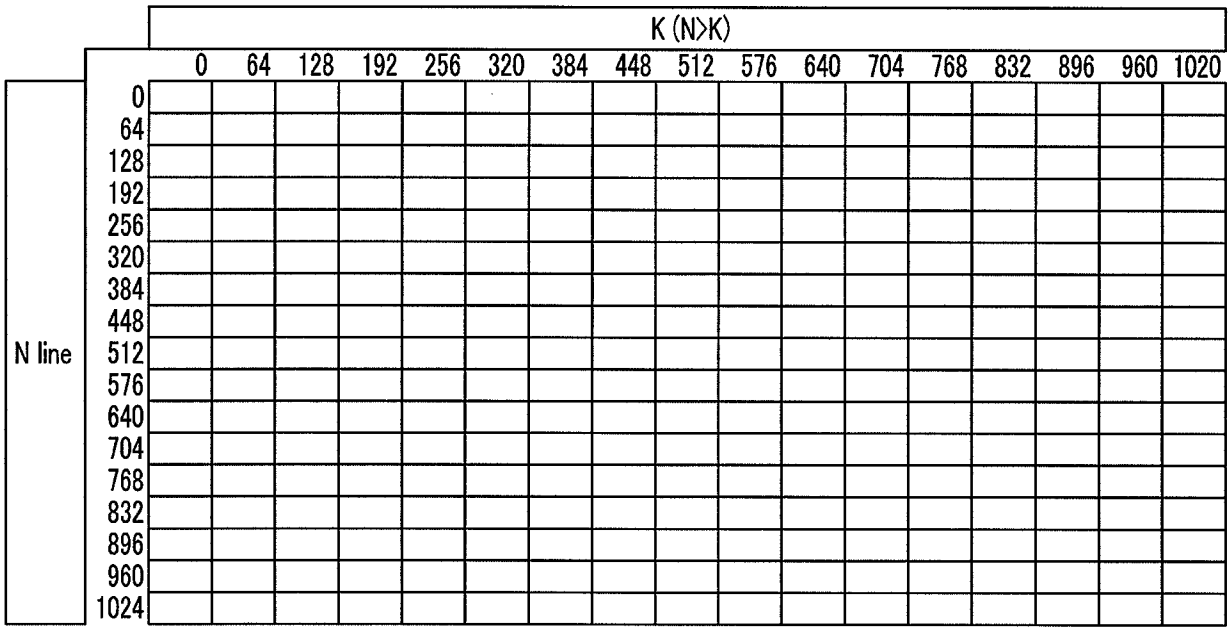
FIG. 4 is a diagram illustrating an example of a lookup table included in a signal controller of the display device according to the exemplary embodiment.
Figure 5:
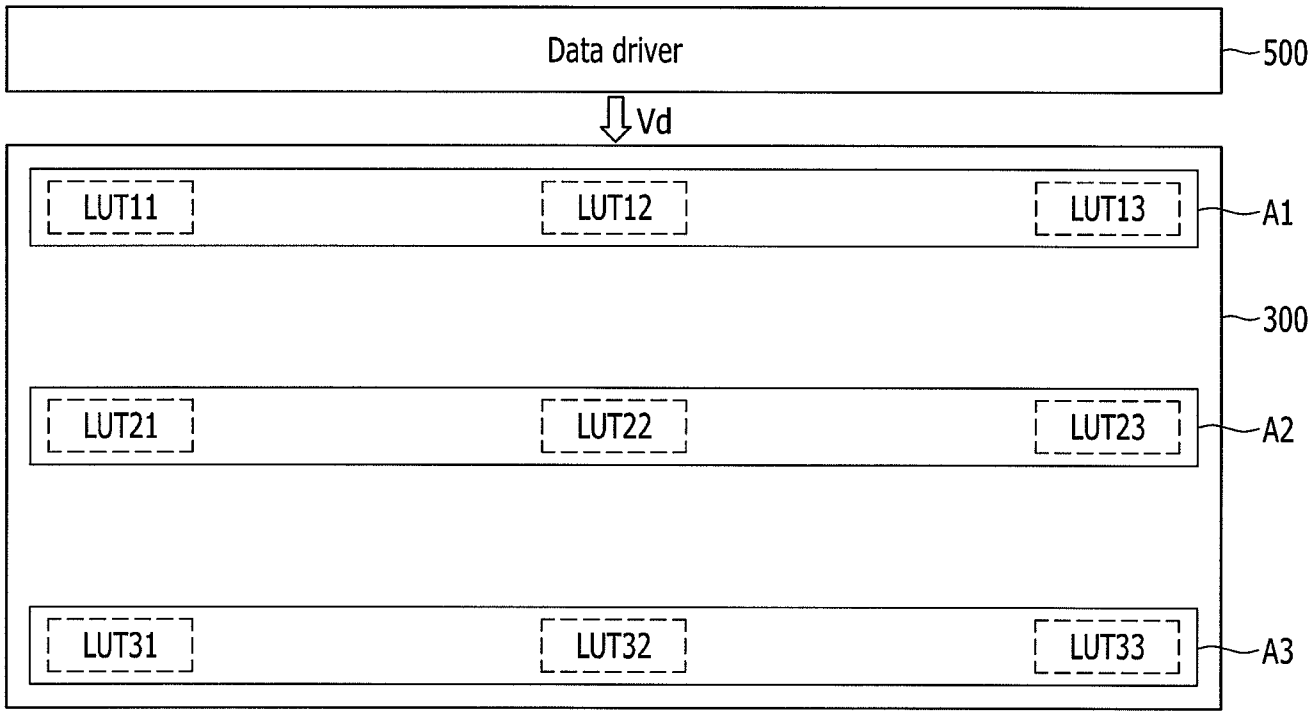
FIG. 5 is a block diagram of a display panel and a data driver of the display device according to the exemplary embodiment.

FIG. 1 is a block, diagram of a display device according to an exemplary embodiment of the described technology, FIG. 2 is a block diagram of a display panel and a data driver of the display device according to the exemplary embodiment, and FIG. 3 is a block diagram of a lookup table included in a signal controller of the display device according to the exemplary embodiment. FIG. 4 is a diagram illustrating an example of a lookup table included in a signal controller of the display device according to the exemplary embodiment and FIG. 5 is a block diagram of a display panel and a data driver of the display device according to the exemplary embodiment.

First, referring to FIG. 1, a display device according to an exemplary embodiment of the described technology includes a display panel 300, a gate driver 400, a data driver 500, and a signal controller 600 controlling the data driver 500 and the gate driver 400.

The display panel 300 may be a display panel which may be included in various flat panel displays (FPDs) such as a liquid crystal display (LCD), an organic light-emitting diode (OLED) display, or an electrowetting display (EWD).

The display panel 300 includes a plurality of gate lines G1-Gn, a plurality of data lines D1-Dm, and a plurality of pixels PX connected to the gate lines G1-Gn and the data lines D1-Dm.

The gate lines G1-Gn transfer gate signals, extend in a row direction, and may be substantially parallel to each other. The data lines D1-Dm transfer data voltages, extend in a column direction, and may be substantially parallel to each other.

The plurality of pixels PX may be arranged in a substantially matrix form. One pixel PX may include at least one switching element connected to the corresponding gate line G1-Gn and the corresponding data line D1-Dm, and at least one pixel electrode connected thereto. The switching element may include at least one thin film transistor, and is turned on or off according to the gate signal received from the gate lines G1-Gn to selectively transfer the data voltage received from the data lines D1-Dm to the pixel electrode. Each pixel PX may display an image at a luminance according to a data voltage applied to the pixel electrode.

In order to implement color display, each pixel PX displays a primary colors (spatial division) or alternately displays primary colors at different times (temporal division) so that a desired color may be recognized by the spatial and temporal sum of the primary colors. An example of the primary colors may include three primary colors such as red, green, and blue. The plurality of adjacent pixels PX displaying different primary colors may configure one set (referred to as a dot) together. One dot may display a white image.

The gate driver 400 receives a gate control signal CONT1 from the signal controller 600 to generate gate signals including a combination of a gate-on voltage Von which can turn on a switching element and a gate-off voltage Voff which can turn off a switching element based on the received gate control signal CONT1. The gate control signal CONT1 includes a scanning start signal STV instructing a scanning start, at least one gate clock signal CPV controlling the output timing of the gate-on voltage Von, and the like. The gate driver 400 is connected with the gate lines G1-Gn of the display panel 300 to apply the gate signals to the gate lines G1-Gn.

The data driver 500 receives a data control signal CONT2 and an output image signal DAT from the signal controller 600 and selects a gray voltage corresponding to each output image signal DAT to convert the output image signal DAT into a data voltages which are analog data signals. The output image signal DAT has a predetermined number of values (or grays) as a digital signal. The data control signal CONT2 includes a horizontal synchronization start signal indicating a transmission start of the output image signal DAT for the pixels PX in one row, at least one data load signal TP instructing a data voltage to be applied to the data lines D1-Dm, a data clock signal, and the like. The data control signal CONT2 may further include an inversion signal which inverts the polarity of the data voltage with respect to a common voltage Vcom (referred to as the polarity of the data voltage). The data driver 500 is connected to the data lines D1-Dm of the display panel 300 to apply data voltages Vd to the corresponding data lines D1-Dm.

In contrast to the illustration of FIG. 1, the data driver 500 may include a pair of data drivers (not illustrated) facing each other above and below a display area, in which the plurality of pixels PX of the display panel 300 are positioned. In this case, the data driver positioned above the display area may apply the data voltages Vd from above the data lines D1-Dm of the display panel 300, and the data driver positioned below the display area may apply the data voltages Vd from below the data lines D1-Dm of the display panel 300. Further, the data lines D1-Dm connected to the data driver positioned below the display area and the data lines D1-Dm connected to the data driver positioned above the display area may be separated from each other.

The signal controller 600 receives an input image signal IDAT and an input control signal ICON controlling the display of the input image signal IDAT from an external graphic processing unit (not illustrated) or the like. The signal controller 600 appropriately processes the input image signal IDAT based on the input image signal IDAT and the input control signal ICON to convert the processed input image signal IDAT into the output image signal DAT. The signal controller 600 generates a gate control signal CONT1, a data control signal CONT2, and the like based on the input image signal IDAT and the input control signal ICON. The signal controller 600 transmits the gate control signal CONT1 to the gate driver 400, and transmits the data control signal CONT2 and the processed output image signal DAT to the data driver 500.

Referring to FIG. 1, the signal controller 600 according to the exemplary embodiment includes a lookup table unit 620 including a plurality of lookup tables LUT. Each lookup table LUT stores correction values for some or all grays of the input image signal IDAT.

Referring to FIGS. 2 and 3, the plurality of lookup tables LUT included in the lookup table unit 620 correspond to different pixel positions in the display panel 300, respectively, and the correction values stored in the lookup table LUT may vary according to the corresponding pixel positions in the display panel 300.

As illustrated in FIG. 2, a first region A1, a second region A2, and a third region A3 which are different regions in the display panel 300 will be described as an example. The first, second, and third regions A1 to A3 correspond to different rows which are charged to the data voltage Vd by different gate signals, respectively, and are distant from the data driver 500 in the order of: the first region A1, the second region A2, and the third region A3.

In this case, the lookup table unit 620 may include a first lookup table LUT1 corresponding to the first region A1, a second lookup table LUT2 corresponding to the second region A2, and a third lookup table LUT3 corresponding to the third region A3, as illustrated in FIG. 3. However, the exemplary embodiment is not limited thereto, and the lookup table unit 620 may include a plurality of lookup tables corresponding to either two regions or four or more regions which are positioned at different distances from the data driver 500, respectively.

The data voltage Vd output from the data driver 500 has a larger signal delay due to a load which is generally increased in accordance with the distance the signal travels from the data driver 500. Accordingly, in order to compensate for such a signal delay of the data voltage according to the pixel position in the display panel 300, a lookup table (e.g., the third lookup table LUT3) corresponding to a region positioned at a distance far away from the data driver 500 may store a larger correction value for a specific gray than a lookup table (e.g., the first lookup table LUT1) positioned at a distance closer to the data driver 500.

Referring to FIG. 4, the lookup tables LUT1, LUT2, and LUT3 may store correction values which depend on the current input image signal IDAT and a previous input image signal for the data voltage Vd applied to another pixel PX immediately before the current input image signal IDAT, with respect to the same data lines D1-Dm. According to another exemplary embodiment, the lookup tables LUT1 to LUT3 may also store correction values which depend on an input image signal corresponding to another pixel PX positioned in a row before the row of the pixel PX corresponding to the current input image signal IDAT, for example, one or more rows before the current row, with respect to the same data lines D1-Dm.

In detail, when a correction value for the current input image signal IDAT is calculated with respect to a data voltage Vd to be charged in an N-th row, the correction value may be found with reference to both a gray value of the current input image signal IDAT and a gray value of the previous input image signal with respect to a data voltage Vd to be charged in a K-th (K is a natural number) row. In this case, the data voltage Vd to be charged in the K-th row may be a data voltage Vd which is to be charged immediately before the data voltage Vd to be charged in the N-th row with respect to the same data lines D1-Dm and applied to a pixel in another row. In this case, a pulse of a data load signal TP with which the data voltage Vd to be charged in the N-th row is substantially synchronized and a pulse of a data load signal TP with which the data voltage Vd to be charged in the K-th row is substantially synchronized may be just adjacent to each other. In this case, K and N may be related such that K<N. As such, the input image signal IDAT for the data voltage Vd to be charged in the K-th row is referred to as a previous input image signal, and the input image signal IDAT for the data voltage Vd to be charged in the N-th row is referred to as a current input image signal.

The signal controller 600 may further include at least one line memory (not illustrated) for storing the previous input image signal.

As such, in the display panel 300, by adding the correction values selected from the lookup tables LUT1 to LUT3 according to the position of a row to be charged to the data voltage Vd, the current input image signal and the previous input image signal, a charging ratio of the data voltage Vd according to a pixel position in the display panel 300 may be compensated.

As the number of gray values of the current input image signal and the previous input image signal stored in the lookup tables LUT1 to LUT3 is increased, the charging ratio may be more accurately compensated. However, since the manufacturing cost of the display device is increased as the number of gray values stored in the lookup tables LUT1 to LUT3 are increased, the number of gray values stored in the lookup tables LUT1 to LUT3 may be appropriately determined in consideration of the associated cost.

FIG. 4 illustrates an example in which the lookup tables LUT1 to LUT3 store correction values for some grays of the current input image signal. In this case, correction values for grays which are not stored in the lookup tables LUT1 to LUT3 may be determined by a calculating method such as various interpolation methods.

Similarly, as the number of lookup tables LUT1 to LUT3 included in the lookup table unit 620 increases, the charging ratio may be more accurately compensated according to the pixel position in the display panel 300. However, since the manufacturing cost increases as the number of lookup tables LUT1 to LUT3 is increased, the number of lookup tables LUT1 to LUT3 may be appropriately determined in consideration of the manufacturing cost. With respect to a region of the display panel 300 where the corresponding lookup tables LUT1 to LUT3 are not provided, the correction values may be calculated through calculating methods such as various interpolation methods by using correction values of the adjacent lookup tables LUT1 to LUT3.

The correction values positioned on a boundary of the adjacent lookup tables LUT1 to LUT3 may be changed if necessary.

The lookup table unit 620 may include a separate lookup table for different pixel positions in the display panel 300, temperatures of the display device or ambient temperatures, or polarities of the data voltage Vd.

Referring to FIG. 5, the lookup table unit 620 may include a plurality of lookup tables corresponding to different positions in a row direction for different regions of the display panel 300 positioned at substantially the same distance from the data driver 500. For example, the lookup table unit 620 may include a plurality of lookup tables LUT11, LUT12, and LUT13 corresponding to the first region A1, a plurality of lookup tables LUT21, LUT22, LUT23 corresponding to the second region A2, and a plurality of lookup tables LUT31, LUT32, LUT33 corresponding to the third region A3. The plurality of lookup tables corresponding to one row may correspond to different positions in one row.

The plurality of lookup tables corresponding to one row may be connected to different data driving circuits according to the position in a horizontal direction even in the case where the plurality of lookup tables are positioned at substantially the same distance from the data driver 500. Furthermore, a variation in manufacturing may be present in the thin film transistor or the signal line such as a data line, and as a result, a deviation in the degree of signal delay may occur according to the position in a horizontal direction even in the same row of pixels PX. Accordingly, as illustrated in FIG. 5, by preparing a plurality of lookup tables with respect to the same row and compensating for the current input image signal by using a plurality of lookup tables, it is possible to compensate for a deviation in the signal delay at different positions in both vertical and horizontal directions of the display panel 300 and more accurately compensate for the charging ratio.

Even in the case, with respect to the regions of the display panel 300 in which corresponding lookup tables are not provided, the correction values may be calculated by a calculating method such as an interpolation method using the correction values of adjacent lookup tables. In the case where there is a lookup table corresponding to a row or a column where a region to be calculated through the interpolation method, correction values may be calculated by using correction values of two lookup tables which correspond to the corresponding row or column and are adjacent to the region to be calculated. In other cases, the correction values may be calculated by using correction values of four lookup tables which are adjacent to the region to be calculated.

For example, in the case where the position of the correction value to be calculated using the interpolation method is in the inside of a quadrangle connecting four points corresponding to four lookup tables LUT21, LUT22, LUT31, and LUT32 as illustrated in FIG. 5, correction values at the corresponding position may be calculated through the interpolation method using the correction values of the four lookup tables LUT21, LUT22, LUT31, and LUT32.

Next, a method of driving the display device according to the exemplary embodiment will be described with reference to FIG. 6 in addition to FIGS. 1 to 5 described above.

Figure 6:
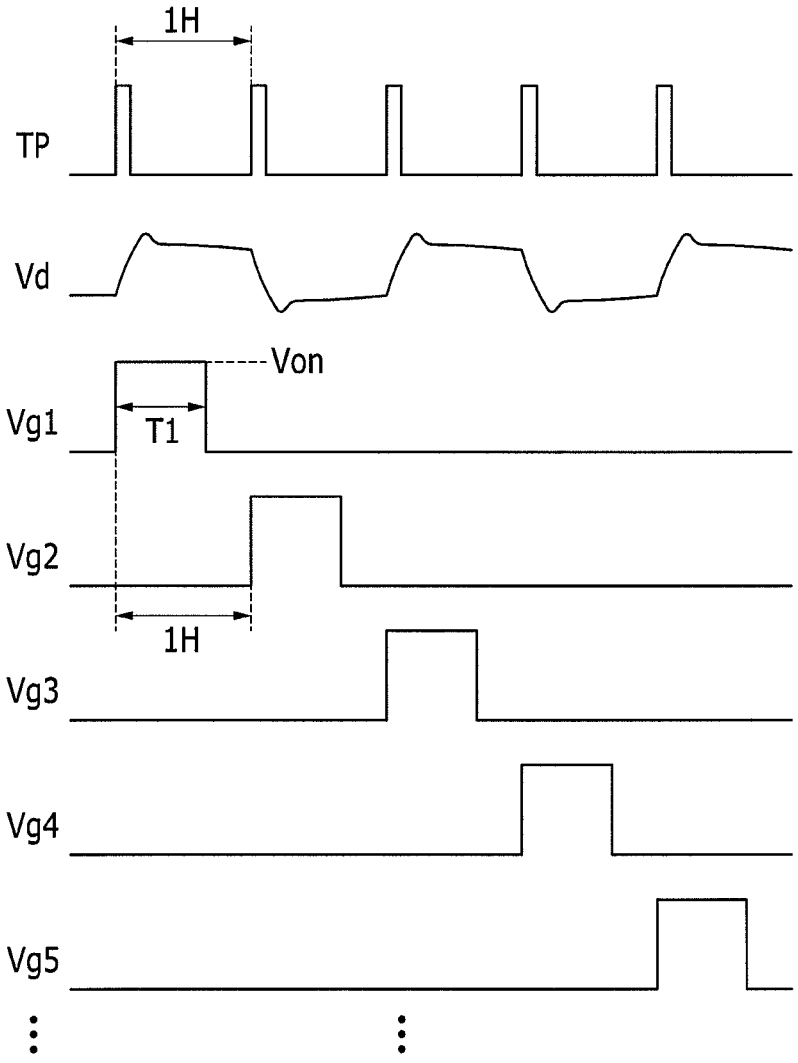
FIG. 6 is a timing diagram of a driving signal of the display device according to an exemplary embodiment.

FIG. 6 is a timing diagram of a driving signal of the display device according to the exemplary embodiment.

The signal controller 600 receives the input image signal IDAT and the input control signal ICON from the an external source and then selects or calculates correction values with reference to the plurality of lookup tables LUT of the lookup table unit 620. The signal controller 600 applies the calculated correction values to the current input image signal to generate a compensated input image signal IDAT'. The compensated input image signal IDAT' may be calculated by adding the correction value to the current input image signal. The signal controller 600 processes the compensated input image signal IDAT' to convert the processed input image signal IDAT' into the output image signal DAT and generate a gate control signal CONT1, a data control signal CONT2, and the like. The signal controller 600 transmits the gate control signal CONT1 to the gate driver 400, and transmits the data control signal CONT2 and the output image signal DAT to the data driver 500.

The data driver 500 receives output image signals DAT for pixels PX in one row according to the data control signal CONT2 received from the signal controller 600 and selects a gray voltage corresponding to each output image signal DAT to convert the output image signal DAT into a data voltage Vd which is an analog data signal and then applies the converted data voltage Vd to the corresponding data lines D1-Dm.

In detail, the data driver 500 sequentially applies data voltages to the data lines D1-Dm substantially synchronized to a rising edge or a falling edge of the data load signal TP. The period between adjacent rising edges of the data load signal TP may be a 1 horizontal period.

The gate driver 400 applies a gate-on voltage Von to the gate lines G1-Gn according to the gate control signal CONT1 received from the signal controller 600 to turn on switching elements connected to the gate lines G1-Gn. Then, the data voltages Vd applied to the data lines D1-Dm are applied to the corresponding pixels PX through the turned-on switching elements.

In detail, the gate driver 400 sequentially applies the gate-on voltages Von of gate signals Vg1, Vg2, . . . to the gate lines G1-Gn substantially synchronized with the rising edges of the data load signal TP. The period between the rising edges of the gate-on voltages Von of the gate signals Vg1, Vg2, . . . applied to the gate lines G1-Gn in adjacent rows may be approximately 1 H. That is, a period in which the gate-on voltages Von are sequentially applied to the gate lines G1-Gn may be approximately 1 H. A width of the gate-on voltage Von applied to one of the gate lines G1-Gn is represented as a first time T1.

As such, when the gate-on voltages Von are applied to the gate lines G1-Gn, the switching elements connected to the gate lines G1-Gn are turned on, and the data voltages Vd applied to the data lines D1-Dm are applied to the corresponding pixels PX through the turned-on switching elements.

The difference between a data voltage applied to the pixel PX and a common voltage Vcom is a pixel voltage. In the case of an LCD, the pixel voltage is a charging voltage of a liquid crystal capacitor, and the arrangement of liquid crystal molecules within the liquid crystal capacitor varies according to the magnitude of the pixel voltage, and as a result, the polarization of light passing through a liquid crystal layer is changed. A change in the polarization is represented as a change in transmittance of light through a polarizer attached to the LCD.

Images of one frame may be displayed by applying the gate-on voltages Von to all the gate lines G1-Gn and applying the data signals to all the pixels PX.

FIG. 6 illustrates an example of a row inversion driving in which the data voltages Vd are inverted for each row, but the described technology is not limited thereto, and the polarity of the data voltage Vd applied to the data lines D1-Dm for one frame may be uniform.

After one frame ends, the next frame starts, and the state of an inversion signal applied to the data driver 500 may be controlled so that the polarity of the data voltage Vd applied to each pixel PX is opposite to the polarity applied in the previous frame. In this case, the polarity of the data voltage Vd flowing through one of the data lines D1-Dm within one frame is periodically changed according to the characteristics of the inversion signal, or the polarities of the data voltages Vd applied to one pixel row may be different from each other, as illustrated in FIG. 6.

As described above, according to a pixel position in the display panel 300 including a distance from the data driver 500 and the like, and the immediately previous data voltage Vd charged to the same data lines D1-Dm, the input image signal IDAT is compensated and then converted into the data voltages Vd to charge the pixels PX in one row, and as a result, the deviation of the charging ratio according to the pixel position in the display panel 300 may be compensated. Accordingly, image quality defects such as charging-type stains due to a decrease in the charging ratio according to the position may be substantially removed.

Next, an example of the previous image signal in the lookup table when the input image signal is compensated in display devices having various structures according to the exemplary embodiment will be described with reference to FIGS. 7 to 9 in addition to the drawings described above.

Figure 7:
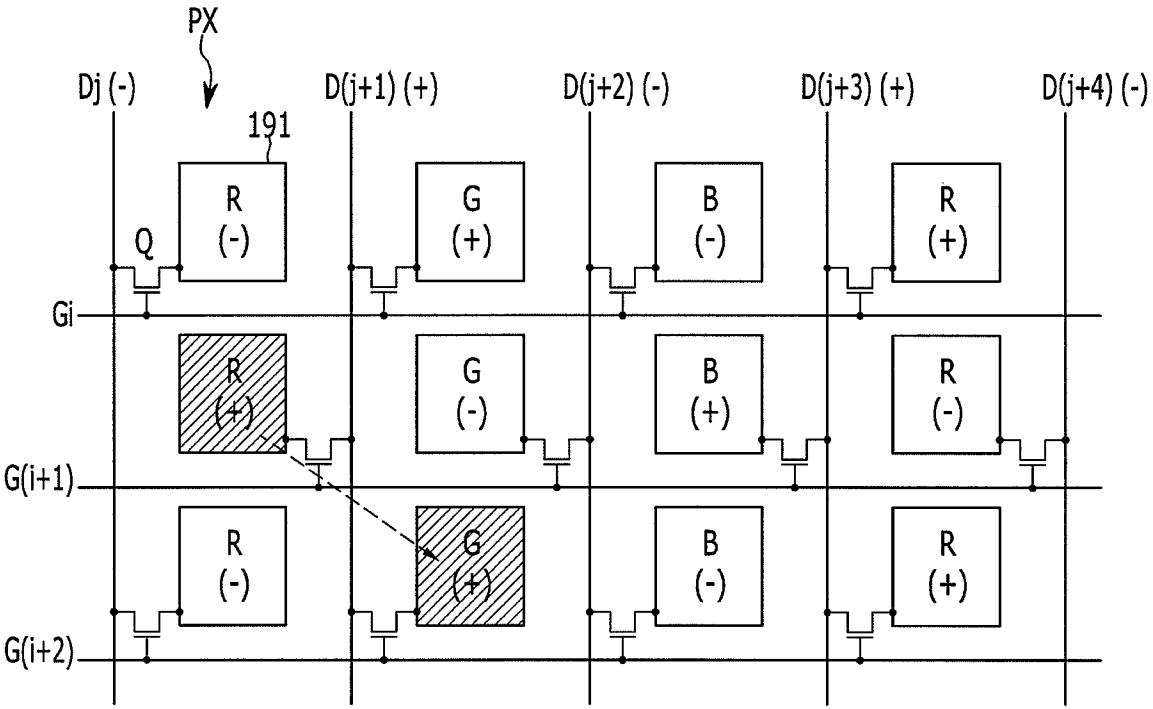
FIGS. 7, 8, and 9 are layout views of pixels and signal lines of the display device according to exemplary embodiments.
Figure 8:
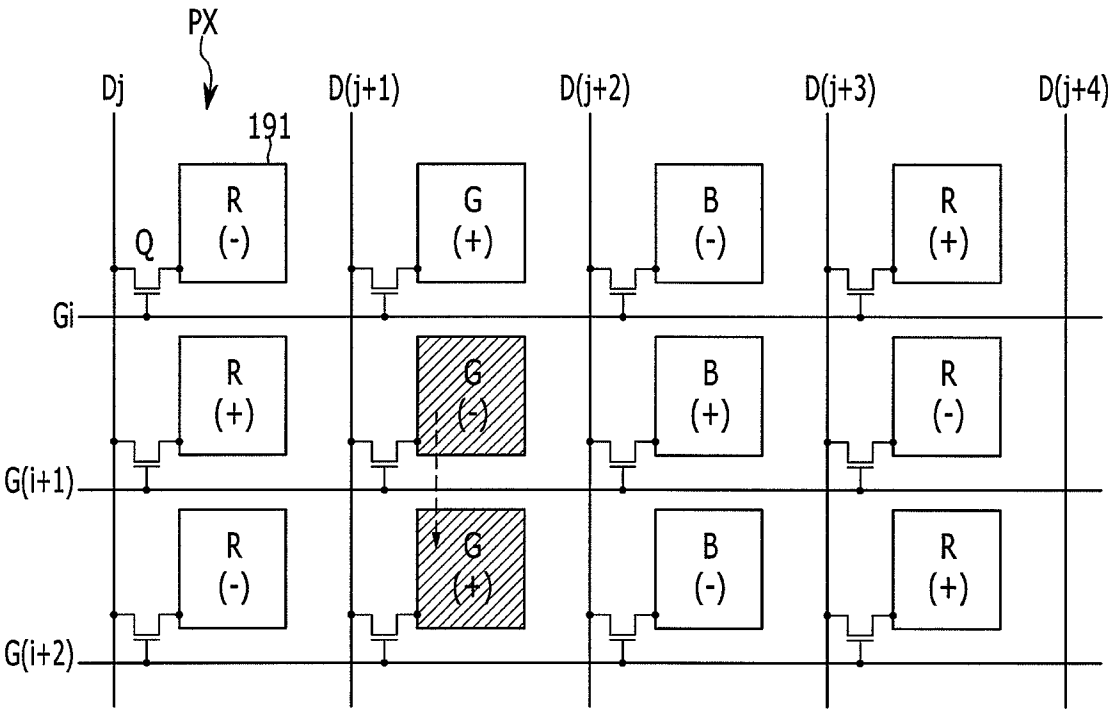
Figure 9:
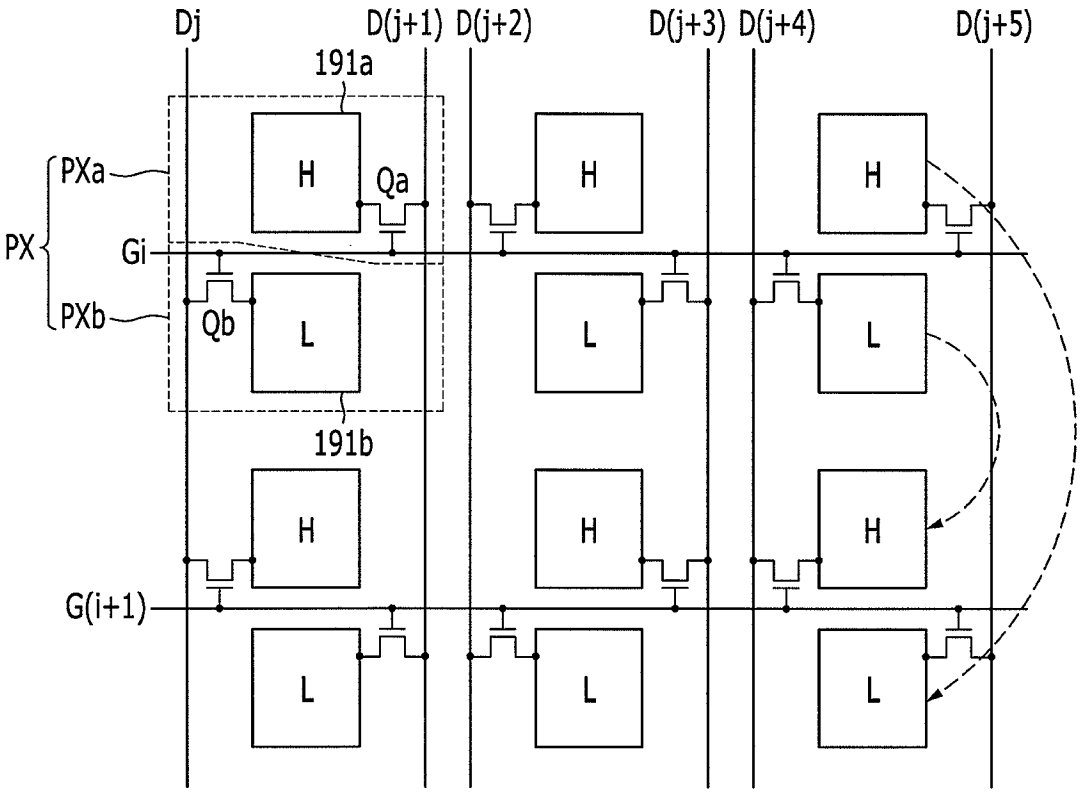

FIGS. 7, 8, and 9 are layout views of pixels and signal lines of the display device according to the exemplary embodiment.

First, referring to FIG. 7, the display panel 300 of the display device according to the exemplary embodiment includes a plurality of gate lines Gi, G(i+1), . . . extending in a row direction, a plurality of data lines Dj, D(j+1), . . . extending in a column direction, and a plurality of pixels PX. Each pixel PX may include a pixel electrode 191 connected to a gate line Gi, G(i+1), . . . and a data line Dj, D(j+1), . . . through a switching element Q. In the exemplary embodiment, each pixel PX is illustrated to display one of the primary colors of red R, green G, and blue B, but is not limited thereto.

Pixels displaying the same primary colors R, G, and B may be disposed in one pixel column. For example, a pixel column of red pixels R, a pixel column of green pixels G, and a pixel column of blue pixels B may be alternately disposed. One of the data lines Dj, D(j+1), . . . is disposed for each pixel column, and one of the gate lines Gi, G(i+1), . . . may be disposed for each pixel row, but the described technology is not limited thereto.

The pixels R, G, and B disposed in one pixel column may be connected to one of two adjacent data lines Dj, D(j+1), . . . . In more detail, as illustrated in FIG. 7, the pixels R, G, and B disposed in one pixel column may be alternately connected to two adjacent data lines Dj, D(j+1), . . . . The pixels R, G, and B positioned in the same pixel row may be connected to the same gate line Gi, G(i+1), . . . .

Data voltages having opposite polarities may be applied to the adjacent data lines Dj, D(j+1), . . . . The data voltage may be polarity-inverted for each frame.

As a result, the adjacent pixels R, G, and B in the column direction may receive data voltages having opposite polarities, and the adjacent pixels R, G, and B in one pixel row may receive data voltages having opposite polarities such that the display device is driven in substantially in a 1×1 dot inversion form. That is, even though the adjacent pixels R, G, and B are driven in a column inversion form in which the data voltages applied to the data lines Dj, D(j+1), . . . maintain the same polarity for one frame, dot inversion driving may be implemented.

According to the exemplary embodiment illustrated in FIG. 7, when an input image signal IDAT corresponding to a data voltage Vd to be charged in for example, a green pixel G connected to the gate line G(i+2) connected to one data line (e.g., data line D(j+1)) through the switching element Q is the current input image signal, the pixel PX charged to the data voltage Vd corresponding to the previous input image signal is a red pixel R connected to the previous gate line G(i+1). That is, the data line D(j+1) transfers the data voltage Vd of the red pixel R connected to the gate line G(i+1) and then transfers the data voltage Vd of the green pixel G connected to the next gate line G(i+2). An arrow illustrated in FIG. 7 represents the order in which the pixels PX are charged with the data voltage Vd from the data line D(j+1).

Accordingly, in the case of the display device illustrated in FIG. 7, the input image signal IDAT for the data voltage Vd to be charged in the K-th row to be referred to in the lookup table LUT of the lookup table unit 620, that is, the previous input image signal, is an input image signal IDAT of an adjacent pixel PX in a diagonal direction, not a pixel PX directly above the pixel PX corresponding to the current input image signal.

In contrast, the display device according to the exemplary embodiment illustrated in FIG. 8 is similar to the display device according to the exemplary embodiment illustrated in FIG. 7 described above, but the pixels R, G, and B disposed in one pixel column which display the same primary colors may be connected to the same data lines Dj, D(j+1), . . . . Data voltages having opposite polarities may be applied to the adjacent data lines Dj, Dj+1, . . . . Further, as illustrated in FIG. 8, the polarity of the data voltage Vd applied to one of the data lines Dj, D(j+1), . . . may be inverted for each row for one frame, but may be uniform for one frame.

According to the exemplary embodiment illustrated in FIG. 8, when an input image signal IDAT corresponding to a data voltage Vd to be charged in for example, a green pixel G connected to the gate line G(i+2) connected to one data line (e.g., data line D(j+1)) through the switching element Q is the current input image signal, the pixel PX charged to the data voltage Vd corresponding to the previous input image signal is a green pixel G connected to the previous gate line G(i+1). That is, the data line D(j+1) transfers the data voltage Vd of the green pixel G connected to the gate line G(i+1) and then transfers the data voltage Vd of the green pixel G connected to the next gate line G(i+2). An arrow illustrated in FIG. 8 represents the order in which the pixels PX are charged to the data voltage Vd from the data line D(j+1).

Accordingly, in the case of the display device according to the exemplary embodiment illustrated in FIG. 8, the previous input image signal to be referred to in the lookup table LUT of the lookup table unit 620 may be a pixel PX directly above the pixel PX corresponding to the current input image signal.

Next, referring to FIG. 9, each pixel PX of the display device according to the exemplary embodiment may include a first subpixel PXa and a second subpixel PXb. Since the first subpixel PXa may generally display an image at higher luminance than the second subpixel PXb with respect to the same gray, in FIG. 9, the first subpixel PXa is represented as "H", and the second subpixel PXb is represented as "L", but they are not limited thereto.

The first subpixel PXa includes a first subpixel electrode 191*a* connected to a first switching element Qa, and the second subpixel PXb includes a second subpixel electrode 191*b* connected to a second switching element Qb. The first switching element Qa and the second switching element Qb may be connected to the same gate line Gi, G(i+1), and different data lines Dj, D(j+1), . . . , as illustrated in FIG. 9.

The first subpixels PXa of the pixels PX disposed in one pixel column may be alternately connected to two adjacent data lines Dj, D(j+1), . . . . Similarly, the second subpixels PXb of the pixels PX disposed in one pixel column may be alternately connected to two adjacent data lines Dj, D(j+1), . . . . Further, the first and second subpixels PXa and PXb of the pixels PX disposed in the same pixel column may be connected to the same gate line Gi, G(i+1), . . . . As a result, one of the data lines Dj, D(j+1), . . . may sequentially transfer the data voltage Vd of the first subpixel PXa and the data voltage Vd of the second subpixel PXb which are included in different pixels PX.

According to the exemplary embodiment illustrated in FIG. 9, when an input image signal IDAT corresponding to a data voltage Vd to be charged in for example, the second subpixel PXb of the pixel PX connected to the gate line G(i+1) connected to one data line (e.g., data line D(j+5)) is the current input image signal, the pixel PX charged at the data voltage Vd corresponding to the previous input image signal is the first subpixel PXa of the pixel PX connected to the previous gate line Gi. That is, the data line D(j+5) transfers the data voltage Vd of the first subpixel PXa of the pixel PX connected to the gate line Gi and then transfers the data voltage Vd of the second subpixel PXb of the pixel PX connected to the next gate line G(i+1). Similarly, the data line D(j+4) transfers the data voltage Vd of the second subpixel PXb of the pixel PX connected to the gate line Gi and then transfers the data voltage Vd of the first subpixel PXa of the pixel PX connected to the next gate line G(i+1). An arrow illustrated in FIG. 9 represents the order in which the pixels PX are charged to the data voltages Vd received from the data line D(j+4) and the data line D(j+5).

Accordingly, in the case of the display device according to the exemplary embodiment illustrated in FIG. 9, an input image signal IDAT for the data voltage Vd to be charged in the K-th row to be referred to in the lookup table LUT of the lookup table unit 620, that is, the previous input image signal is an input image signal IDAT of the second subpixel PXb of the pixel PX directly above the first subpixel PXa in the case where the subpixel corresponding to the current input image signal is the first subpixel PXa, and is input image signal IDAT of the first subpixel PXa of the pixel PX directly above the second subpixel PXb in the case where the subpixel corresponding to the current input image signal is the second subpixel PXb.

In addition, the structure of the display device may be varied, and as a result, the input image signal IDAT for the data voltage Vd to be charged in the K-th row to be referred to in the lookup table LUT of the lookup table unit 620 may vary accordingly.

Next, a display device according to an exemplary embodiment will be described with reference to FIG. 10. The same constituent elements as the exemplary embodiments described above designate the same reference numerals, and duplicate description thereof are omitted.

Figure 10:
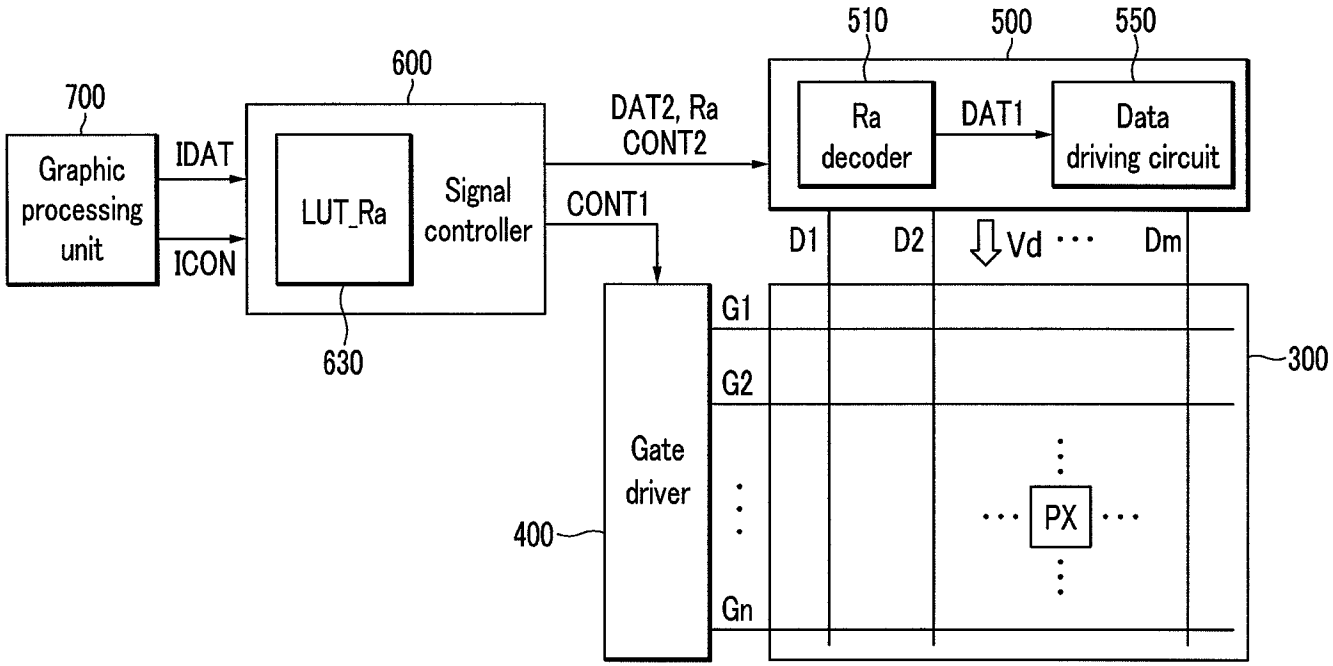
FIG. 10 is a block diagram of a display device according to an exemplary embodiment.

FIG. 10 is a block diagram illustrating a display device according to an exemplary embodiment.

The display device according to the exemplary embodiment illustrated in FIG. 10 is similar to the exemplary embodiment described above, except the signal controller 600 and the data driver 500 may be different from those of the exemplary embodiment described above.

The signal controller 600 according to the present exemplary embodiment includes a lookup table LUT_Ra 630 storing a correction ratio Ra. The correction ratio Ra represents a degree of compensation of the charging ratio of the input image signal IDAT or the output image signal DAT as a ratio. The correction ratio Ra may vary according to pixel position information of the pixel PX, for example, the distance of the pixel PX from the data driver 500. For example, as the pixel PX to which the data voltage Vd is input is further away from the data driver 500, the correction ratio Ra may be increased.

According to another exemplary embodiment, the correction ratio Ra stored in the lookup table 630 may depend on the position of the pixel PX to which the data voltage Vd is input and the previous input image signal for the data voltage Vd which is applied to the same data lines D1-Dm to which the corresponding pixel PX is connected and which charges another pixel PX. For example, the previous input image signal may have a larger correction ratio Ra at a low gray than at a high gray. Since the rest of the features of the present embodiment are similar to those of the exemplary embodiment described above, detailed descriptions thereof are omitted.

In the exemplary embodiment, the signal controller 600 may not include the lookup table unit 620 described above.

The data driver 500 receives the output image signal DAT2 and the correction ratio Ra together with the data control signal CONT2 from the signal controller 600. The output image signal DAT2 is a signal generated when the signal controller 600 processes the input image signal IDAT like the output image signal DAT of the exemplary embodiment described above. In some embodiments, the correction ratio Ra is positioned at a horizontal blank period positioned between the output image signals DAT for adjacent rows to be transmitted to the data driver 500. In this case, a separate transmission line for transmitting the correction ratio Ra is not required. Alternatively, the correction ratio Ra may be input to the data driver 500 through a separate transmission line from the output image signal DAT.

The data driver 500 may include a correction ratio decoder 510 and a data driving circuit 550.

The correction ratio decoder 510 generates a compensated output image signal DAT1 by correcting the output image signal DAT2 by using the correction ratio Ra received from the signal controller 600. For example, the correction ratio decoder 510 may generate the compensated output image signal DAT1 by multiplying the output image signal DAT2 by the correction ratio Ra.

The data driving circuit 550 receives the compensated output image signal DAT1 and the output image signal DAT2 to generate a data voltage Vd corresponding to each compensated output image signal DAT1 and a data voltage Vd corresponding to each output image signal DAT2. The data driver 500 may continuously output the data voltage Vd corresponding to the compensated output image signal DAT1 and the data voltage Vd corresponding to the output image signal DAT2 for about 1 horizontal period 1 H in one pixel row.

In contrast to the embodiment illustrated in FIG. 10, the correction ratio decoder 510 may be included in the signal controller 600.

Next, a driving method of a display device according to an exemplary embodiment will be described with reference to FIG. 11 in addition to FIG. 10 described above.

Figure 11:
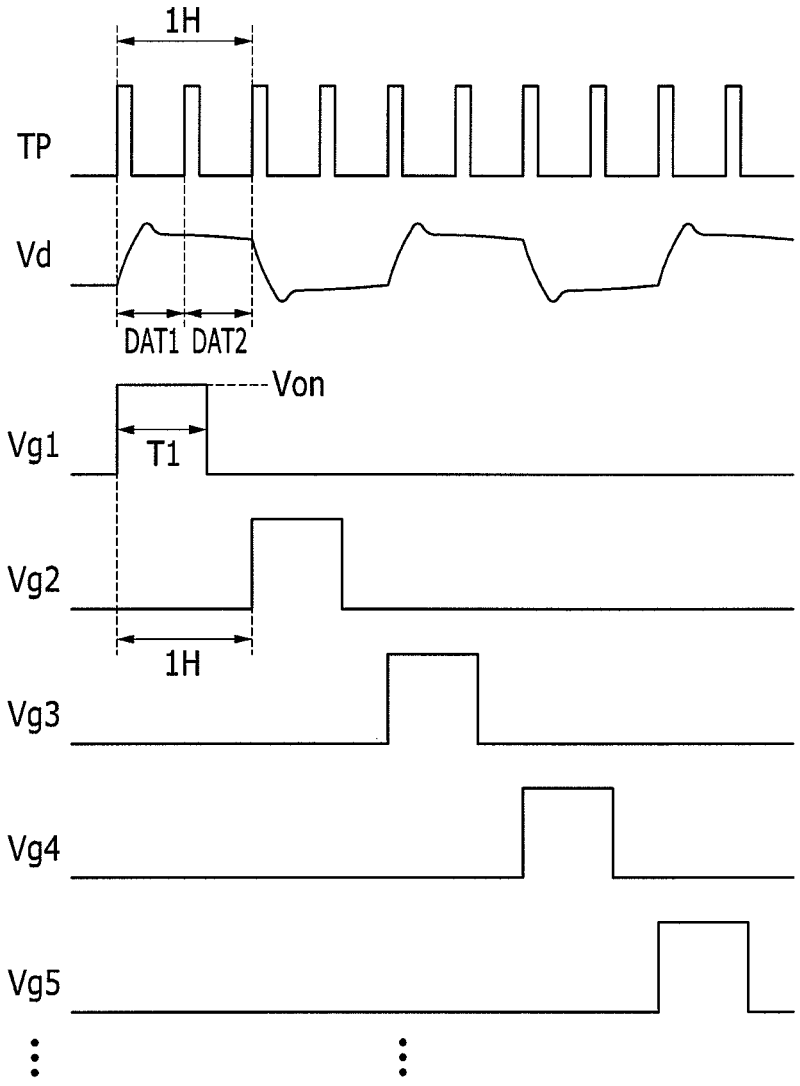
FIG. 11 is a timing diagram of a driving signal of the display device according to an exemplary embodiment.

FIG. 11 is a timing diagram of a driving signal of the display device according to the exemplary embodiment.

The signal controller 600 receives an input image signal IDAT and an input control signal ICON from an external source and then processes the input image signal IDAT to convert the processed input image signal IDAT into the output image signal DAT2 and generate a gate control signal CONT1, a data control signal CONT2, and the like. The signal controller 600 further calculates a correction ratio Ra with reference to the lookup table 630. In the case where the lookup table 630 stores the correction ratios Ra for only some pixel positions of the display panel 300, the rest of the correction ratios Ra may be calculated by various interpolation methods. Similarly, in the case where the lookup table 630 stores the correction ratios Ra for only some of the grays of the previous input image signal, the rest of the correction ratios Ra may be calculated by various interpolation methods.

The signal controller 600 transmits the gate control signal CONT1 to the gate driver 400, and transmits the output image signal DAT2 and the correction ratio Ra together with the data control signal CONT2, to the data driver 500.

According to the data control signal CONT2 received from the signal controller 600, the data driver 500 receives the output image signal DAT2 and the correction ratio Ra for the pixels PX in one row, and generates the compensated output image signal DAT1 by applying the correction ratio Ra to the output image signal DAT2. The data driver 500 selects gray voltages corresponding to each output image signal DAT2 and the compensated output image signal DAT1 to convert the gray voltages into the data voltages Vd.

Referring to FIG. 11, the data driver 500 sequentially applies the data voltages Vd corresponding to the compensated output image signal DAT1 and the data voltages Vd corresponding to the output image signal DAT2 to the data lines D1-Dm substantially synchronized with a rising edge or a falling edge of the data load signal TP. The interval between adjacent rising edges of the data load signal TP may be approximately ½ of a horizontal period. That is, the data voltages Vd are applied to the pixels PX in one row twice for each 1 horizontal period 1 H.

The gate driver 400 applies gate-on voltages Von to the gate lines G1-Gn according to the gate control signal CONT1 received from the signal controller 600 to turn on the switching elements connected to the gate lines G1-Gn. Then, the data voltages Vd applied to the data lines D1-Dm are applied to the corresponding pixels PX through the turned-on switching elements.

The gate driver 400 sequentially applies the gate-on voltages Von of the gate signals Vg1, Vg2, . . . to the gate lines G1-Gn. The interval between the rising edges of the gate-on voltages Von of the gate signals Vg1, Vg2, . . . applied to the gate lines G1-Gn in adjacent rows may be substantially 1 H. That is, the period in which the gate-on voltages Von are sequentially applied to the gate lines G1-Gn may be approximately 1 H. A width of the gate-on voltage Von applied to one of the gate lines G1-Gn is referred to as a first time T1 (or a first period T1).

As such, when the gate-on voltages Von are applied to the gate lines G1-Gn, the switching elements connected to the gate lines G1-Gn are turned on, and the data voltages Vd applied to the data lines D1-Dm are applied to the corresponding pixels PX through the turned-on switching elements.

FIG. 11 illustrates an example employing row inversion driving in which the data voltages Vd are inverted for each row, but the described technology is not limited thereto, and a polarity of the data voltage Vd applied to one of the data lines D1-Dm for one frame may be uniform.

According to the exemplary embodiment, the data voltages Vd corresponding to the compensated output image signal DAT1 to which the correction ratio Ra is applied is output earlier than the data voltages Vd corresponding to the output image signal DAT2. Accordingly, since the data voltages Vd in which the distance between the pixel PX and the data driver 500 and the deviation in the charging ratio due to the previous data voltage Vd of the same data lines D1-Dm are compensated for is applied early in the 1 horizontal period 1 H, according to a pixel position in the display panel 300, it is possible to compensate for the deviation in the charging ratio due to a deviation in signal delay and substantially prevent image quality defects such as charging-type stains.

Next, a display device according to an exemplary embodiment will be described with reference to FIG. 12. The same constituent elements as the exemplary embodiments described above are designated with the same reference numerals, and duplicate descriptions thereof are omitted.

Figure 12:
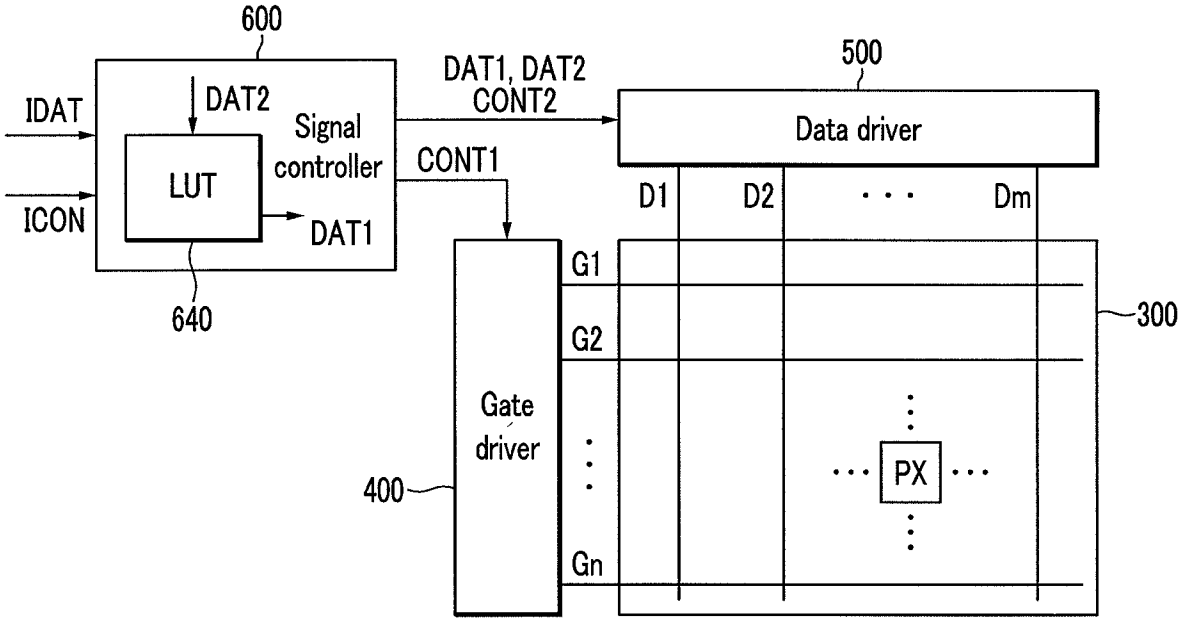
FIG. 12 is a block diagram of a display device according to an exemplary embodiment.

FIG. 12 is a block diagram illustrating a display device according to an exemplary embodiment.

The display device according to the exemplary embodiment illustrated in FIG. 12 is similar to the exemplary embodiment illustrated in FIGS. 10 and 11 described above, except the signal controller 600 and the data driver 500 may be different from those of the exemplary embodiments described above.

The signal controller 600 according to the present exemplary embodiment may include a lookup table 640 storing a value of a compensated output image signal DAT1 according to a pixel position of a pixel PX in the display panel 300 and an output image signal DAT2. For example, the value of a compensated output image signal DAT1 stored in the lookup table 640 may have a larger value than the output image signal DAT2 for a pixel PX positioned farther from the data driver 500.

The signal controller 600 appropriately processes the input image signal IDAT to convert the processed input image signal IDAT into the output image signal DAT2 and then generates the compensated output image signal DAT1 by using the lookup table 640. The signal controller 600 transmits the compensated output image signal DAT1 and the output image signal DAT2 to the data driver 500 through separate transmission lines.

In contrast to the embodiment illustrated in FIG. 10, the lookup table 640 may store values of the input image signal IDAT received from an external source and a compensated input image signal (not illustrated) according to the pixel position of the pixel PX in the display panel 300. In this case, the signal controller 600 appropriately processes the compensated input image signal to generate the compensated output image signal DAT1 and then may transmit the generated compensated output image signal DAT1 together with the output image signal DAT2 to the data driver 500.

The data driver 500 converts the compensated output image signal DAT1 and the output image signal DAT2 received from the signal controller 600 into data voltages Vd, respectively, and then sequentially applies the converted data voltages Vd to the data lines D1-Dm for about 1 horizontal period 1 H, similar to the exemplary embodiment illustrated in FIG. 11 described above. The interval between adjacent rising edges of the data load signal TP may be approximately ½ of a horizontal period. That is, the data voltages Vd are applied to the pixels PX in one row twice for each 1 horizontal period 1 H.

According to the present exemplary embodiment, the data voltages Vd corresponding to the compensated output image signal DAT1 according to the pixel position of the pixel PX in the display panel 300 is output earlier than the data voltages Vd corresponding to the output image signal DAT2. Accordingly, since the data voltages Vd, in which the deviation in the charging ratio due to the distance difference between the pixel PX and the data driver 500 is compensated for, are input early in the 1 horizontal period 1 H, it is possible to compensate for the deviation in the charging ratio due to a deviation in signal delay according to the pixel position in the display panel 300 and substantially prevent image quality defects such as charging-type stains.

Next, a display device according to an exemplary embodiment will be described with reference to FIGS. 13 and 14. The same constituent elements as the exemplary embodiments described above are designated with the same reference numerals, and duplicate descriptions thereof are omitted.

Figure 13:
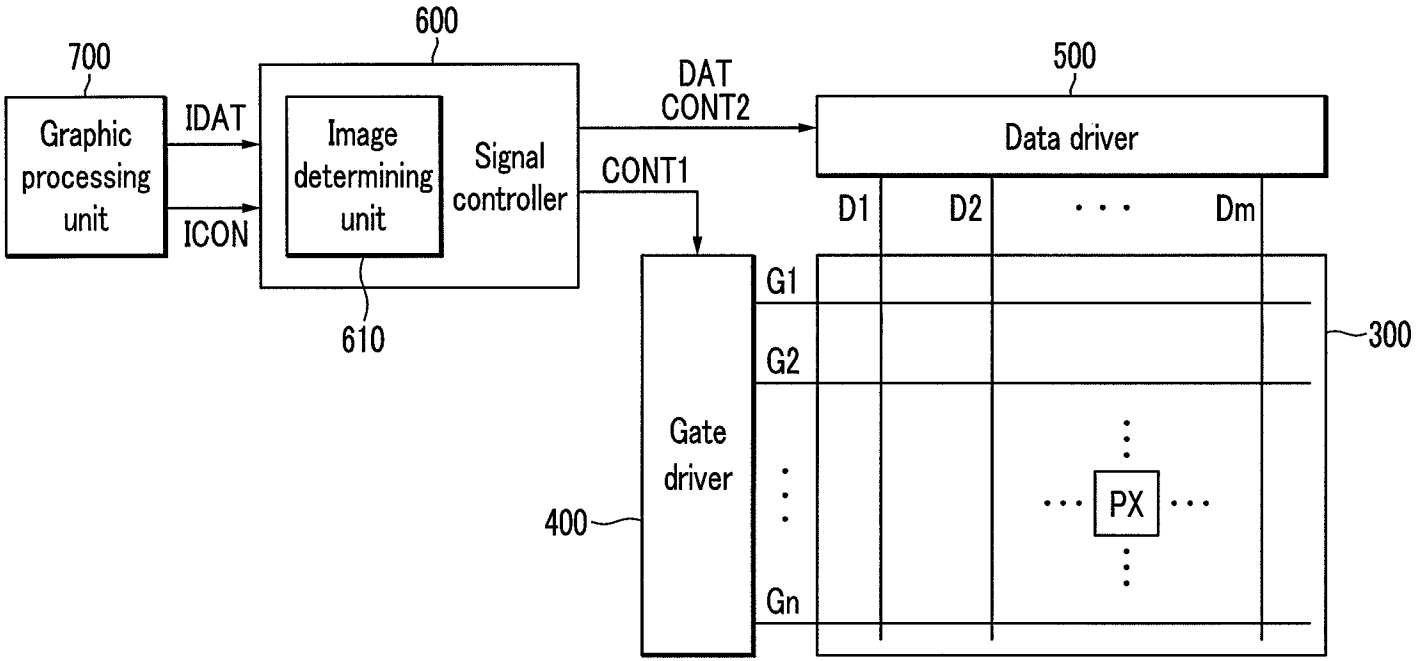
FIGS. 13 and 14 are block diagrams of a display device according to an exemplary embodiment.
Figure 14:
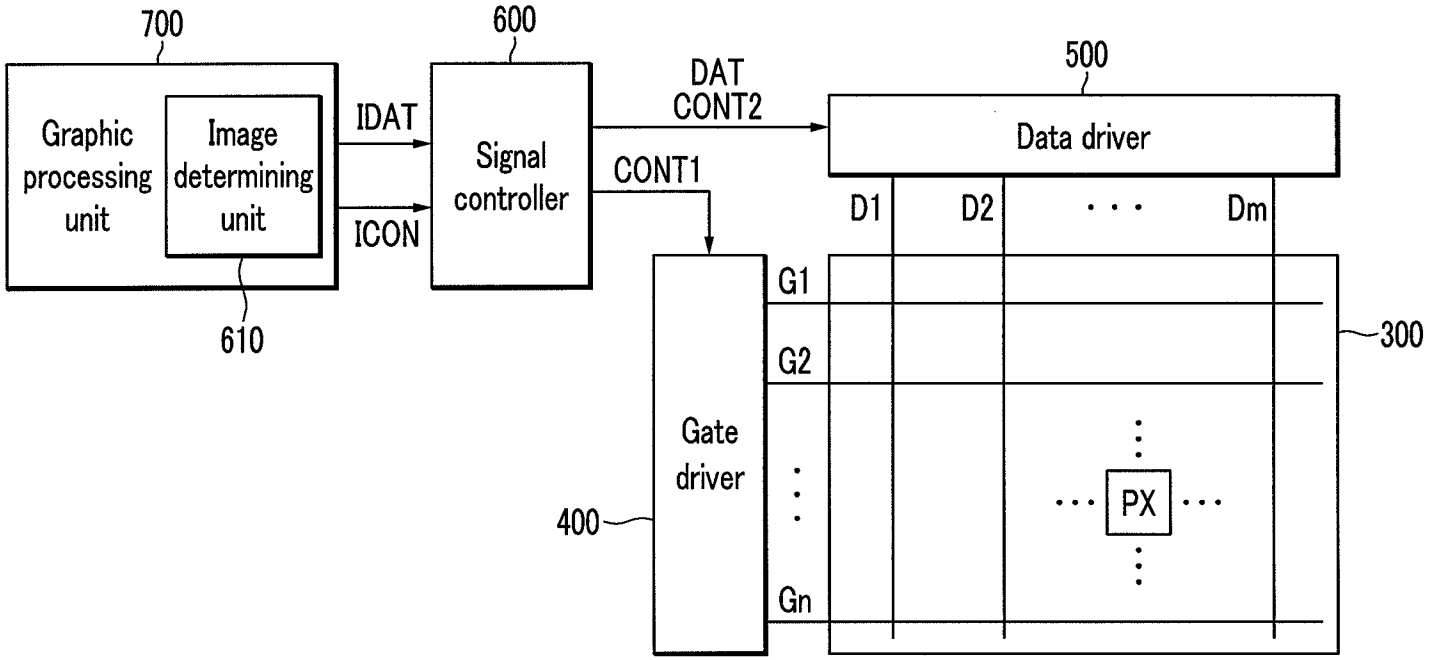

FIGS. 13 and 14 are block diagrams of a display device according to exemplary embodiments.

First, referring to FIG. 13, the display device according to the present exemplary embodiment is similar to the display device according to the exemplary embodiments described above, except the signal controller 600 and the data driver 500 may be different from those of the exemplary embodiments described above, and a graphic processing unit 700 may be further included.

The graphic processing unit 700 receives image data from an external source and then processes the image data to generate an input image signal IDAT, and transmits the input image signal IDAT and an input control signal ICON controlling a display of the input image signal IDAT to the signal controller 600. The input image signal IDAT stores luminance information for each pixel PX, and the luminance information has a predetermined number of grays. An example of the input control signal ICON includes a vertical synchronization signal Vsync, a horizontal synchronization signal Hsync, a main clock signal, a data enable signal DE indicating the start and end of the data in one row, and the like. Further, in order to reduce motion blur, in some embodiments, the graphic processing unit 700 may include or not include a frame rate controller (not illustrated) performing a frame rate control in which an intermediate frame is inserted between adjacent frames, and the like.

According to an exemplary embodiment, the graphic processing unit 700 may transmit an input image signal IDAT for each frame to the signal controller 600 for a moving image displaying period when a moving image is displayed, and not transmit the input image signal IDAT to the signal controller 600 for a still image displaying period when a still image is displayed and be inactive for the still image displaying period. Here, the still image period is a period including at least one frame which displays a still image, and the moving image period is a period including at least one frame which displays a moving image. Further, the still image is an image in which images of sequential frames are substantially the same image, and the moving image is an image in which that the images of sequential frames are different images. In detail, the still image may be defined as a case where the entire images of the sequential frames are substantially the same as each other or a case where a predetermined portion of images among the entire images of the sequential frames are substantially the same as each other.

In this case, the graphic processing unit 700 transmits an input image signal IDAT for the moving image to the signal controller 600 and then may transmit a still image start signal to the signal controller 600 at the conversion time when the input image signal IDAT for the still image is transmitted. The graphic processing unit 700 further transmits a still image end signal to the signal controller 600 at the conversion time when the moving image period starts to input the input image signal IDAT for each frame to the signal controller 600 again. According to some embodiments, signal controller 600 may store an input image signal IDAT of a frame in which the still image starts in a separate frame memory (not illustrated) when the still image start signal is input from the graphic processing unit 700. The signal controller 600 processes the input image signal IDAT stored in the frame memory for the still image displaying period to generate the output image signal DAT. The signal controller 600 may inactivate the graphic processing unit 700 so that the graphic processing unit 700 does not transmit the input image signal IDAT until the still image period ends. In the moving image displaying period, the signal controller 600 may not use the frame memory.

According to another exemplary embodiment, the graphic processing unit 700 may transmit the input image signal IDAT for each frame to the signal controller 600 without distinguishing between still images and moving images.

The signal controller 600 receives an input image signal IDAT and an input control signal ICON controlling a display of the input image signal IDAT from the graphic processing unit 700. The signal controller 600 appropriately processes the input image signal IDAT based on the input image signal IDAT and the input control signal ICON to convert the processed input image signal IDAT into the output image signal DAT. The signal controller 600 generates a gate control signal CONT1, a data control signal CONT2, and the like based on the input image signal IDAT and the input control signal ICON. The signal controller 600 transmits the gate control signal CONT1 to the gate driver 400, and transmits the data control signal CONT2 and the processed output image signal DAT to the data driver 500.

Referring to FIG. 13, the signal controller 600 according to the exemplary embodiment may include an image determining unit 610 determining whether the input image signal IDAT is a still image or a moving image. In this case, the image determining unit 610 may determine the input image signal IDAT to be a still image in the case where an input image signal IDAT in a current frame is substantially the same as an input image signal IDAT in a previous frame, and determine the input image signal IDAT to be a moving image in the case where the input image signal IDAT in the current frame is not substantially the same as the input image signal IDAT in the previous frame. According to embodiments, the signal controller 600 may further include a frame memory (not illustrated) which stores the input image signal IDAT in the previous frame to aid in the determination by the image determining unit 610.

Referring to FIG. 14, in the display device according to the exemplary embodiment, the image determining unit 610 determining whether the input image signal IDAT is a still image or a moving image may not be included in the signal controller 600, but may instead be included in the graphic processing unit 700. In this case, the image determining unit 610 may generate an image determining signal STL which is a flag signal indicating that the input image signal IDAT in the current frame is a still image or a moving image. According to embodiments, the image determining signal STL may include the still image start signal and the still image end signal described above. As such, the generated image determining signal STL is transmitted from the graphic processing unit 700 to the signal controller 600 together with the input image signal IDAT and the input control signal ICON. In this case, the signal controller 600 may not include a frame memory (not illustrated) for storing the input image signal IDAT in the previous frame and may reduce the hardware cost of the display device.

According to some embodiments, image determining unit 610 may be included in a frame rate controller in the case where the graphic processing unit 700 includes a frame rate controller (not illustrated).

According to another exemplary embodiment, the display device according to the exemplary embodiment may not include the image determining unit 610. In this case, the image determining signal STL may be input from an external source together with the image data.

Next, a driving method of a display device according to an exemplary embodiment will be described with reference to FIGS. 15 to 22 in addition to FIGS. 13 and 14 described above.

Figure 15:
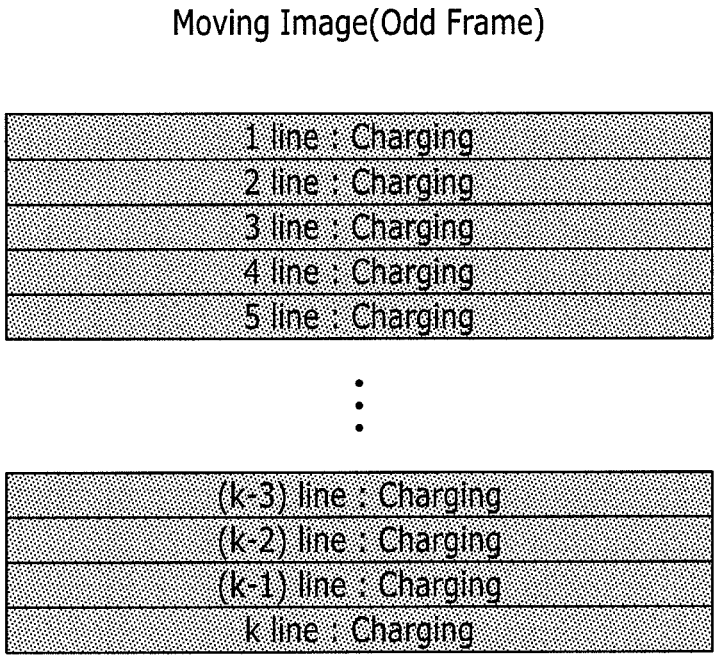
FIG. 15 is a diagram illustrating a pixel row charged in an odd numbered frame when a moving image is displayed on the display device according to the exemplary embodiment.
Figure 16:
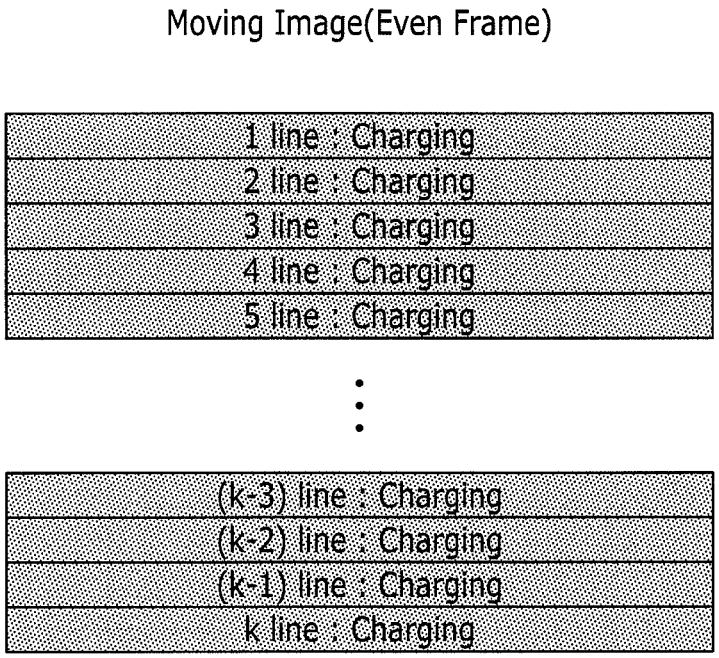
FIG. 16 is a diagram illustrating a pixel row charged in an even numbered frame when a moving image is displayed on the display device according to the exemplary embodiment.
Figure 17:
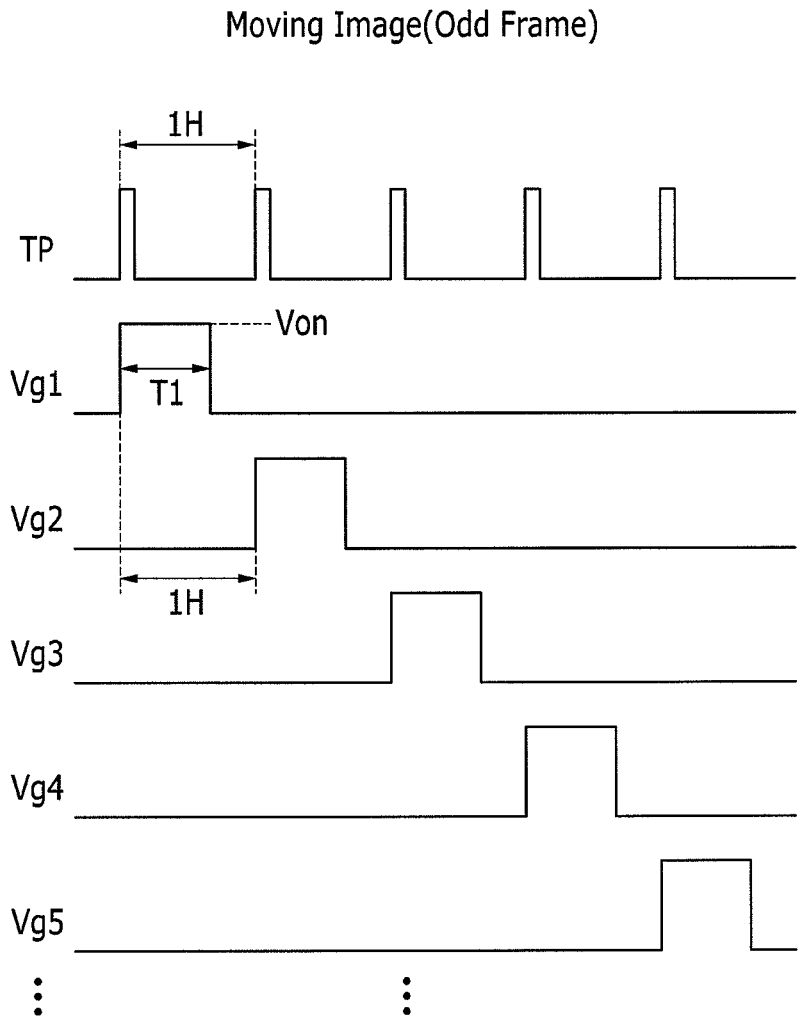
FIG. 17 is a timing diagram of a driving signal in an odd numbered frame when a moving image is displayed on the display device according to the exemplary embodiment.
Figure 18:
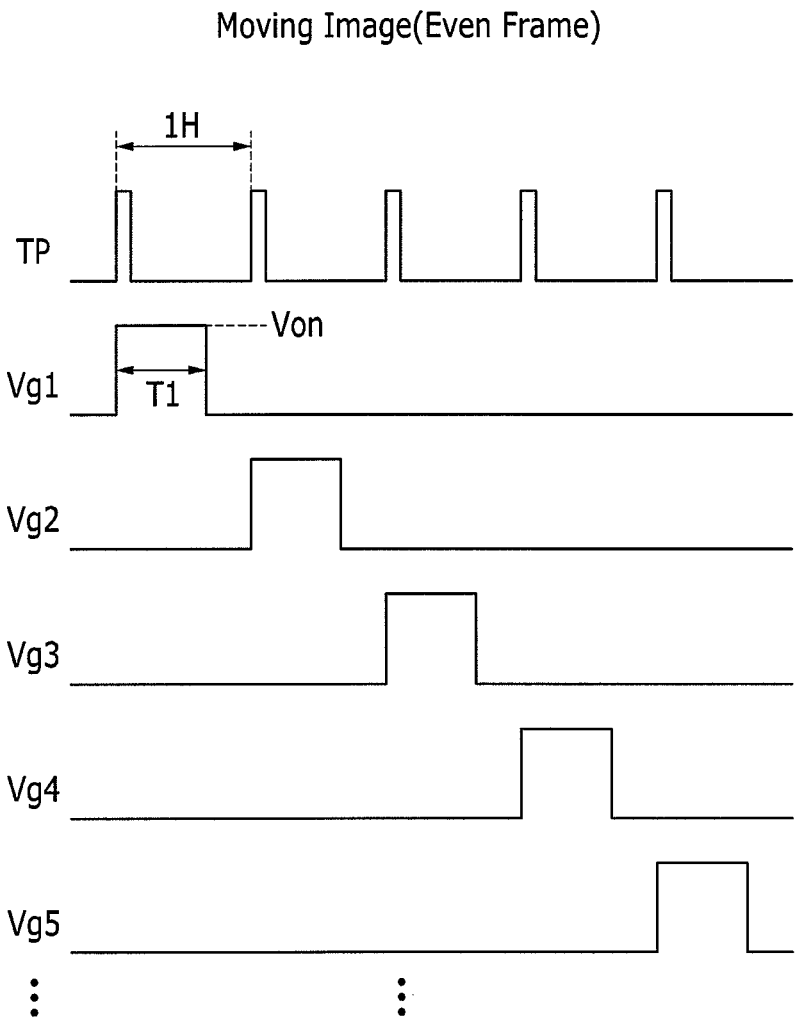
FIG. 18 is a timing diagram of a driving signal in an even numbered frame when a moving image is displayed on the display device according to the exemplary embodiment.
Figure 19:
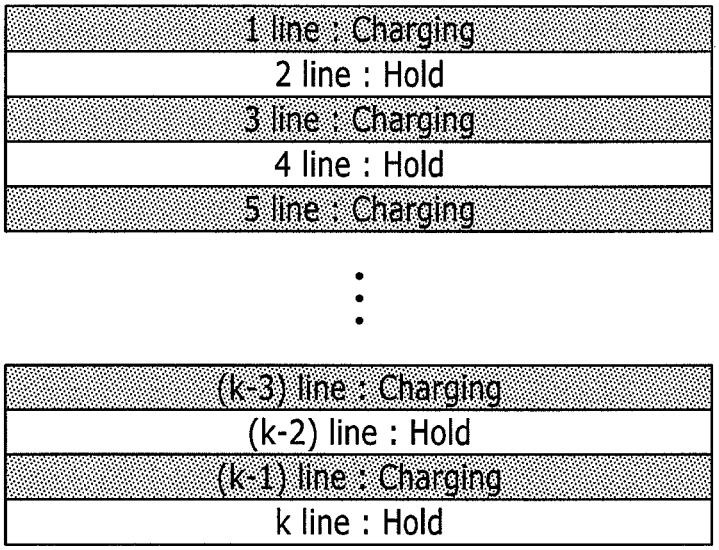
FIG. 19 is a diagram illustrating a pixel row charged in an odd numbered frame when a still image is displayed on the display device according to the exemplary embodiment.
Figure 20:
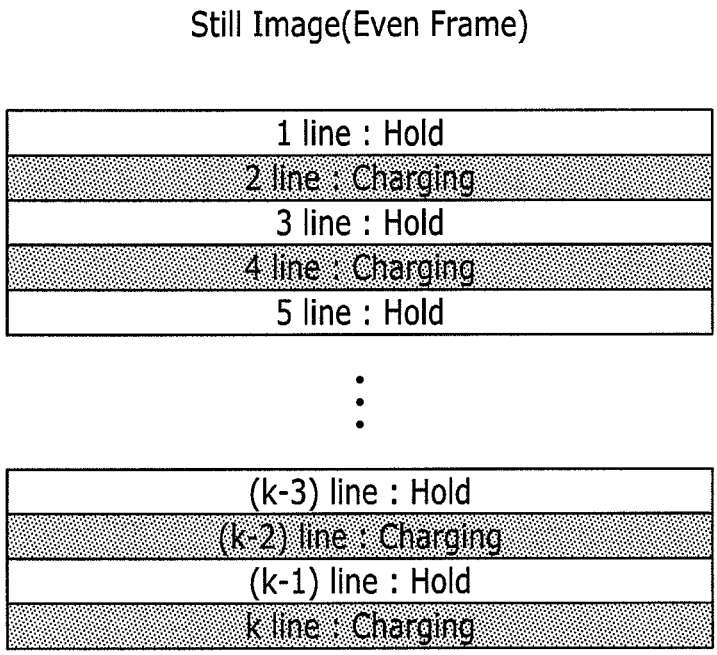
FIG. 20 is a diagram illustrating a pixel row charged in an even numbered frame when a still image is displayed on the display device according to the exemplary embodiment.
Figure 21:
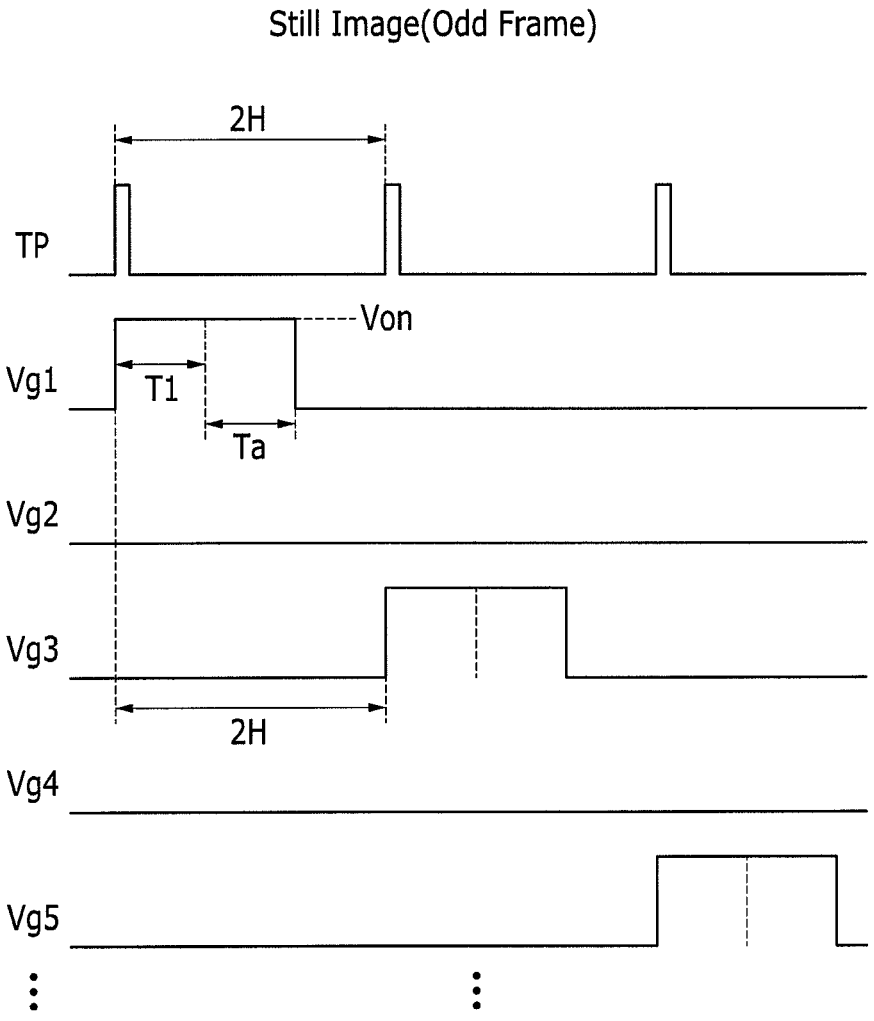
FIG. 21 is a timing diagram of a driving signal in an odd numbered frame when a still image is displayed on the display device according to the exemplary embodiment.
Figure 22:
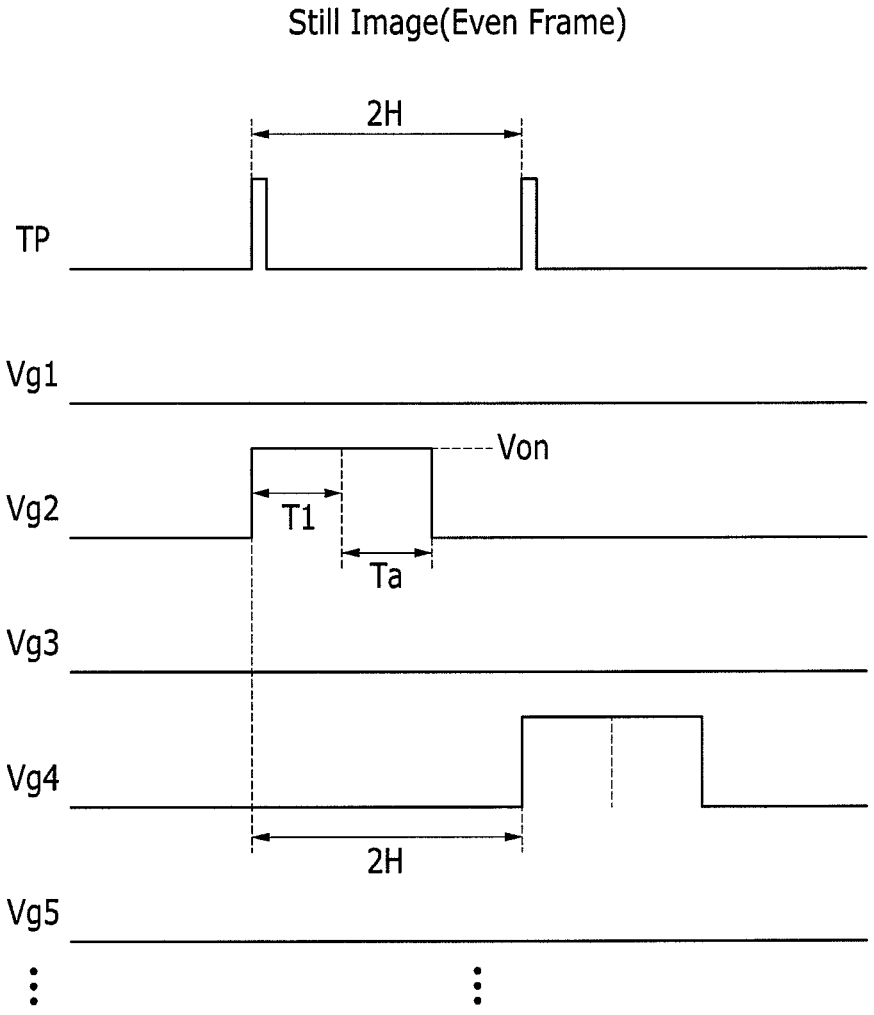
FIG. 22 is a timing diagram of a driving signal in an even numbered frame when a still image is displayed on the display device according to the exemplary embodiment.

FIG. 15 is a diagram illustrating a pixel row charged in an odd numbered frame when a moving image is displayed in the display device according to the exemplary embodiment and FIG. 16 is a diagram illustrating a pixel row charged in an even numbered frame when a moving image is displayed on the display device according to the exemplary embodiment. FIG. 17 is a timing diagram of a driving signal in an odd numbered frame when a moving image is displayed on the display device according to the exemplary embodiment and FIG. 18 is a timing diagram of a driving signal in an even numbered frame when a moving image is displayed on the display device according to the exemplary embodiment. FIG. 19 is a diagram illustrating a pixel row charged in an odd numbered frame when a still image is displayed on the display device according to the exemplary embodiment and FIG. 20 is a diagram illustrating a pixel row charged in an even numbered frame when a still image is displayed on the display device according to the exemplary embodiment. FIG. 21 is a timing diagram of a driving signal in an odd numbered frame when a still image is displayed on the display device according to the exemplary embodiment and FIG. 22 is a timing diagram of a driving signal in an even numbered frame when a still image is displayed on the display device according to the exemplary embodiment.

The signal controller 600 processes the input image signal IDAT received from the graphic processing unit 700 to convert the processed input image signal IDAT into an output image signal DAT, and generates a gate control signal CONT1 and a data control signal CONT2 based on the input image signal IDAT and the input control signal ICON. The signal controller 600 transmits the gate control signal CONT1 to the gate driver 400, and transmits the data control signal CONT2 and the output image signal DAT to the data driver 500.

According to the data control signal CONT2 received from the signal controller 600, the data driver 500 receives the output image signals DAT for pixels PX in one row and selects a gray voltage corresponding to each output image signal DAT to convert the output image signal DAT into an analog data signal, and then applies the converted analog data signal to the corresponding data lines D1-Dm.

In detail, referring to FIGS. 15 to 18, when the display device displays a moving image, data load signals TP may be substantially the same as each other in all frames. The data driver 500 sequentially applies data voltages to the data lines D1-Dm substantially synchronized with a rising edge or a falling edge of the data load signal TP. The interval between adjacent rising edges of the data load signal TP may be about 1 horizontal period [written as "1 H" and substantially the same as one period of a horizontal synchronizing signal Hsync and a data enable signal DE].

On the contrary, referring to FIGS. 19 to 22, when the display device displays a still image, data load signals TP in adjacent frames may be different from each other or substantially the same as each other. In detail, when one frame set including i (i is a natural number of 2 or more) frames is periodically repeated, the data load signals output from the signal controller 600 for one frame set may be substantially the same as each other, and may include i different data load signals TP1 and TP2. FIGS. 19 to 22 illustrate an example in which one frame set includes two frames, and two different data load signals TP1 and TP2 are output. Hereinafter, the case where one frame set includes i frames will be described.

The interval between adjacent rising edges of one of the data load signals TP1 and TP2 may be i times 1 H. That is, a pulse period of the data load signals TP1 and TP2 in the case of displaying a still image may be two or more times a pulse period of the data load signal TP in the case of displaying a moving image. FIGS. 19 to 22 illustrate an example in which an interval between adjacent rising edges of each of the data load signals TP1 and TP2 in the case of displaying a still image is about 2 H, and a pulse period of each of the data load signals TP1 and TP2 is approximately two times a pulse period of the data load signal TP in the case of displaying a moving image.

Further, when different data load signals TP1 and TP2 are used, rising edges of i data load signals TP1 and TP2 output for one frame set do not overlap each other and may be disposed at an interval of at least about 1 H. That is, in the case where the different data load signals TP1 and TP2 are used, i data load signals TP1 and TP2 output for one frame set may have a phase difference of at least about 1 H. According to the exemplary embodiment illustrated in FIGS. 19 to 22, the data load signal TP1 and the data load signal TP2 may have a phase difference of approximately 1 H.

The gate driver 400 applies gate-on voltages Von to the gate lines G1-Gn according to the gate control signal CONT1 received from the signal controller 600 to turn on switching elements connected to the gate lines G1-Gn. Then, the data voltages applied to the data lines D1-Dm are applied to the corresponding pixels PX through the turned-on switching elements.

In detail, referring to FIGS. 15 to 18, when the display device displays a moving image, the gate driver 400 sequentially applies gate-on voltages Von of the gate signals Vg1, Vg2, . . . to the gate lines G1-Gn substantially synchronized with the rising edge or the falling edge of the data load signal TP. The interval between the rising edges of the gate-on voltages Von of the gate signals Vg1, Vg2, . . . applied to the gate lines G1-Gn in adjacent rows may be substantially 1 H. That is, the period in which the gate-on voltages Von are sequentially applied to the gate lines G1-Gn may be approximately 1 H. In the case of displaying a moving image, the width of the gate-on voltage Von applied to one of the gate lines G1-Gn is represented as a first time T1 (or a first period T1).

Referring to FIGS. 19 to 22, in the case of displaying a still image, the gate driver 400 sequentially applies gate-on voltages Von of the gate signals Vg1, Vg2, . . . to the gate lines G1-Gn with a predetermined row interval substantially synchronized with the rising edge or the falling edge of each of the data load signals TP1 and TP2. For one frame set, one of the gate lines G1-Gn may only receive the gate-on voltages Von once.

In detail, when one frame set includes i frames, in each frame, any one of the gate lines G1-Gn receives the gate signals Vg1, Vg2, . . . and then the next gate signals Vg1, Vg2, . . . may be applied to gate lines G1-Gn in an i-th row. In one frame, the interval between rising edges of the gate-on voltages Von of the gate signals Vg1, Vg2, . . . applied to the gate lines G1-Gn which sequentially receive the gate signals Vg1, Vg2, . . . may be approximately i times 1 H. Further, in adjacent frames, two gate lines G1-Gn which first receive the gate signals Vg1, Vg2, . . . may be positioned in immediately adjacent rows.

The exemplary embodiment illustrated in FIGS. 19 to 22 illustrates an example in which one frame set includes two frames, and in each frame, any one of the gate lines G1-Gn receives the gate signals Vg1, Vg2, . . . and then the next gate signals Vg1, Vg2, . . . are applied to the gate lines G1-Gn positioned in a row two rows away from the corresponding gate lines G1-Gn. In this case, in one frame, the interval between rising edges of the gate-on voltages Von of the gate signals Vg1, Vg2, . . . applied to the gate lines G1-Gn which sequentially receive the gate signals Vg1, Vg2, . . . may be approximately 2 H. That is, according to the exemplary embodiment illustrated in FIGS. 19 to 22, in an odd numbered frame, the gate signals Vg1, Vg3, . . . may be sequentially applied to the odd numbered gate lines G1, G3, . . . , and in an even numbered frame, the gate signals Vg2, Vg4, . . . may be sequentially applied to the even numbered gate lines G2, G4, . . . .

In this case, in each frame included in one frame set, the positions of rising edges of the gate-on voltages Von of the first gate signals Vg1 and Vg2 which are applied to the gate lines G1-Gn in each frame may be substantially the same as each other or different from each other. For example, in the case where the data load signals TP1 and TP2 used in adjacent frames are not synchronized with each other, in each frame included in one frame set, the positions of rising edges of the gate-on voltages Von of the first gate signals Vg1 and Vg2 which are applied to the gate lines G1-Gn in each frame may be different from each other.

As such, when the gate-on voltages Von are applied to the gate lines G1-Gn, the switching elements connected to the gate lines G1-Gn are turned on, and the data voltages applied to the data lines D1-Dm are applied to the corresponding pixels PX through the turned-on switching elements.

The difference between the data voltage applied to the pixel PX and the common voltage Vcom is a pixel voltage. In an LCD, the pixel voltage is a charging voltage of a liquid crystal capacitor, and the arrangement of liquid crystal molecules in the liquid crystal capacitor varies according to a magnitude of the pixel voltage, and as a result, the polarization of light passing through a liquid crystal layer is changed. A change in the polarization is represented as a change in transmittance of light through a polarizer attached to the LCD.

In the exemplary embodiment illustrated in FIGS. 15 to 22, k (k is a natural number) pixel rows are illustrated.

As such, one image is displayed by applying the gate-on voltages Von to all the gate lines G1-Gn to apply the data signals to all the pixels PX. Referring to FIGS. 15 and 16, in the case of displaying a moving image, the pixels PX in all rows are charged for each frame, and as a result, one image may be displayed for each frame. On the contrary, referring to FIGS. 19 and 20, in the case of displaying a still image, for one frame, approximately (1/i) of the pixels PX are charged, and for different frames included in one frame set, different pixels PX are charged, and as a result, one image may be displayed over one frame set. The exemplary embodiment illustrated in FIGS. 19 and 20 illustrates an example in which in the odd numbered frame, pixels PX in the odd numbered rows are sequentially charged, and in the even numbered frame, pixels PX in the even numbered rows are sequentially charged, and as a result, one image is displayed over two adjacent frames.

Particularly, according to the exemplary embodiment, in the case of displaying a still image, as illustrated in FIGS. 21 and 22, the length of a period in which the gate-on voltage Von is applied to one of the gate lines G1-Gn, that is, the period in which one pixel PX is charged to the data voltage may be increased by an additional charging time Ta when compared with the first time T1 in the case of displaying a moving image. Here, the additional charging time Ta is substantially equal to or greater than 0. In the case of displaying a still image, the application time of each gate-on voltage Von including the additional charging time Ta may be increased up to approximately i times the first time T1 which is the application time of the gate-on voltage when displaying a moving image. Accordingly, since the charging time of the pixels PX connected to each of the gate lines G1-Gn may be increased if necessary, image quality defects such as spots due to a shortage of the charging ratio may be reduced.

Further, according to an exemplary embodiment, since the pulse period of the data load signals TP1 and TP2 in the case of displaying the still image may be increased to the multiple of the pulse period of the data load signal TP in the case of displaying the moving image, the output number of data voltages per hour in the data driver 500 may be reduced, and as a result, heat generated in the data driver 500 may be reduced and power consumption may be further reduced.

Further, according to an exemplary embodiment, for one frame, a changed period of the data voltage Vd applied to one of the data lines D1-Dm may be increased, and as a result, the heat generated in the data driver 500 may be further reduced. Particularly, in the related art, when a predetermined pattern having a large swing frequency of the data voltage is applied from the data driver 500, all of the pixels PX may be charged in all rows for one frame. However, according to the exemplary embodiment, a swing frequency of the data voltage applied from the data driver 500 may be reduced from a minimum of about ½ to a maximum of about 1/N (N is a natural number and corresponds to the number of all rows to be charged). This will be described in further detail with reference to FIGS. 23 to 26.

Figure 23:
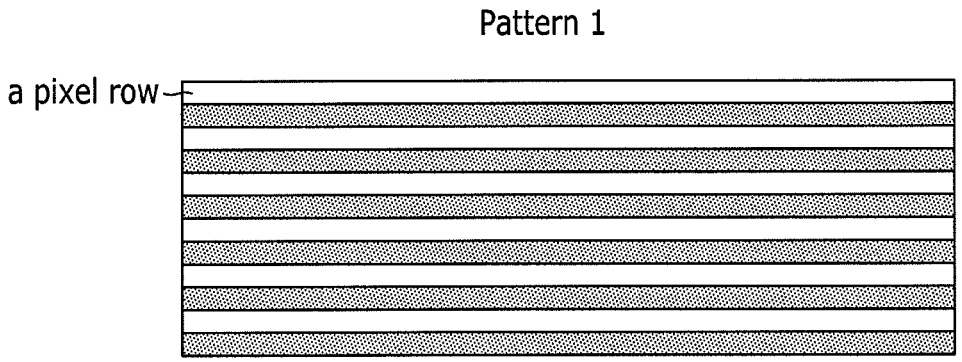
FIG. 23 is a diagram illustrating one pattern displayed by the display device according to the exemplary embodiment.
Figure 24:
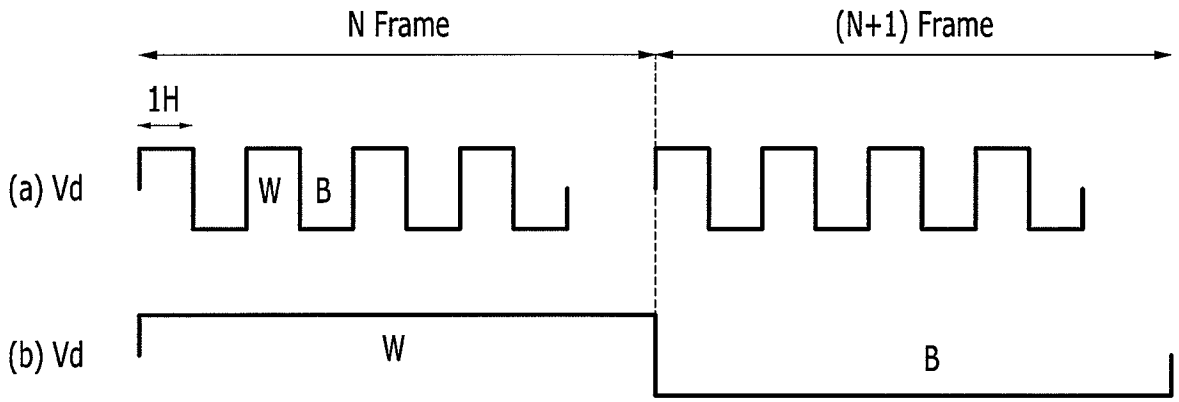
FIG. 24 is a timing diagram of a data voltage in the display device according to the exemplary embodiment.
Figure 25:
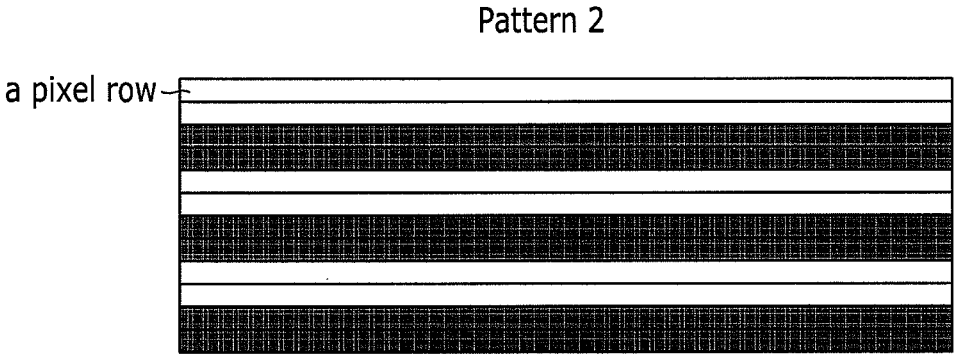
FIG. 25 is a diagram illustrating one pattern displayed by the display device according to the exemplary embodiment.
Figure 26:
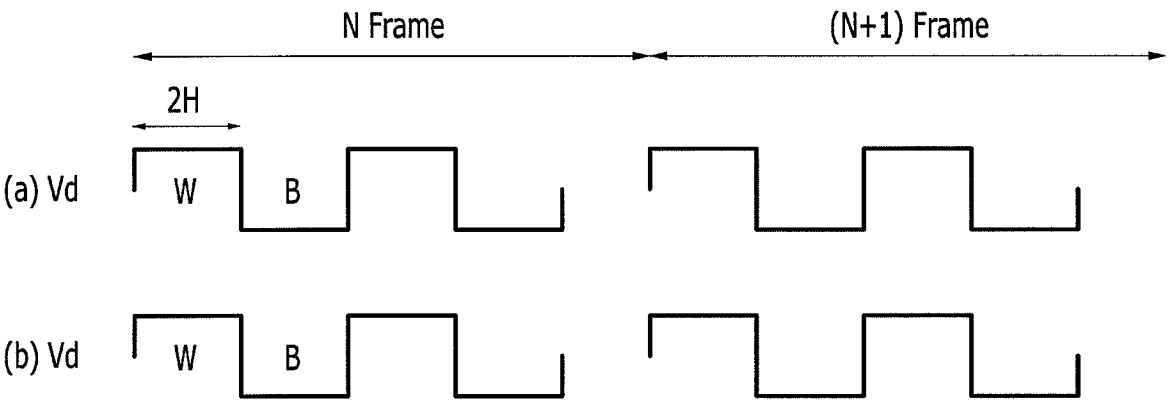
FIG. 26 is a timing diagram of a data voltage in the display device according to the exemplary embodiment.

FIG. 23 is a diagram illustrating one pattern displayed by the display device according to the exemplary embodiment and FIG. 24 is a timing diagram of a data voltage in the display device according to the exemplary embodiment. FIG. 25 is a diagram illustrating one pattern displayed by the display device according to the exemplary embodiment and FIG. 26 is a timing diagram of a data voltage in the display device according to the exemplary embodiment.

First, referring to FIGS. 23 and 24, a first specific pattern in which low grays (e.g., black B) and high grays (e.g., white W) are alternately displayed for each pixel row will be exemplified.

In this case, like the related art, in the case where the pixels PX in all rows are charged in one frame, as illustrated in FIG. 24(*a*), a swing frequency of the data voltage Vd applied from the data driver 500 is about 1 horizontal period 1 H. Accordingly, in the case of alternately displaying black and white for each row, since the data voltage Vd swings between a maximum voltage and a minimum voltage over a period of about 1 H, the data driver 500 generating the data voltage Vd generates a large amount of heat.

However, according to an exemplary embodiment, as illustrated in FIG. 24(*b*), since the data voltage Vd applied from the data driver 500 is applied so as to charge only an even numbered rows or odd numbered rows in one frame, the swing frequency of the data voltage Vd is 1 frame or more. Accordingly, in the case of the first specific pattern displaying black and white alternately for each row, the data voltage Vd does not swing, but may be uniformly maintained and output for one frame, and as a result, the heat generated in the data driver 500 is relatively small.

Next, referring to FIGS. 25 and 26, a second specific pattern in which low grays (e.g., black B) and high grays (e.g., white W) are alternately displayed every two pixel rows will be exemplified.

In this case, like the related art, in the case where the pixels PX in all rows are charged for one frame, as illustrated in FIG. 26(*a*), the swing frequency of the data voltage Vd applied from the data driver 500 is about 2 H. Accordingly, in the case of alternately displaying black and white every two rows, the data voltage Vd swings between a maximum voltage and a minimum voltage at a period of about 2 H.

According to an exemplary embodiment, as illustrated in FIG. 26(*b*), since the data voltage Vd applied from the data driver 500 is applied so as to charge only even numbered rows or odd numbered rows for one frame, the swing frequency of the data voltage Vd is about 2 H as the case illustrated in FIG. 26(*a*). Accordingly, in the case of the second specific pattern illustrated in FIG. 25, the data voltage Vd swings at substantially the same period in both the driving method in the related art and the case of displaying the moving image. In this case, the swing frequency of the data voltage Vd may be approximately ½ of the swing frequency of the data voltage Vd when the first specific pattern is displayed by a method of charging all rows for one frame like the driving method in the related art, and the heat generated in the data driver 500 may be reduced by the swing frequency.

Next, a driving method of a display device according to an exemplary embodiment will be described with reference to FIGS. 27 to 30 together with the drawings described above.

Figure 27:
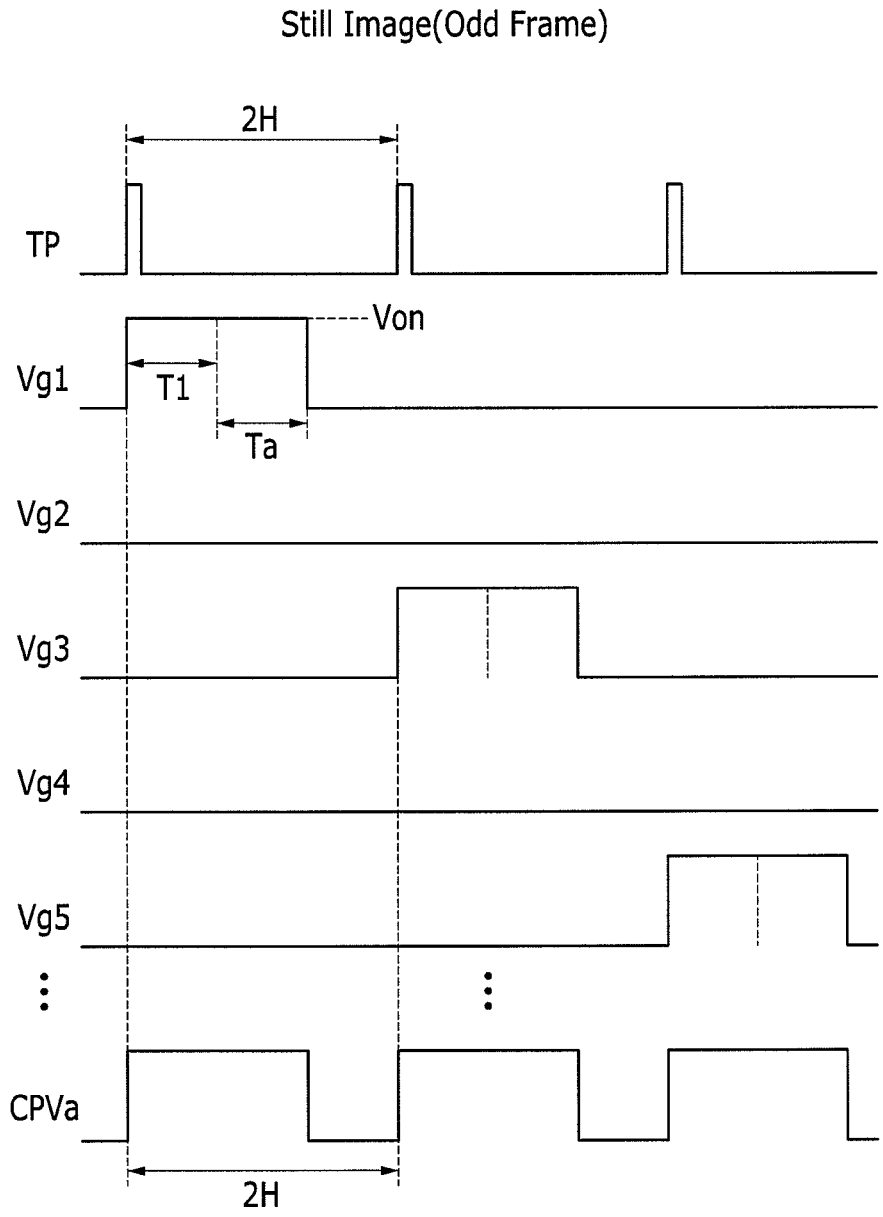
FIG. 27 is a timing diagram of a driving signal in an odd numbered frame when a still image is displayed on the display device according to the exemplary embodiment.
Figure 28:
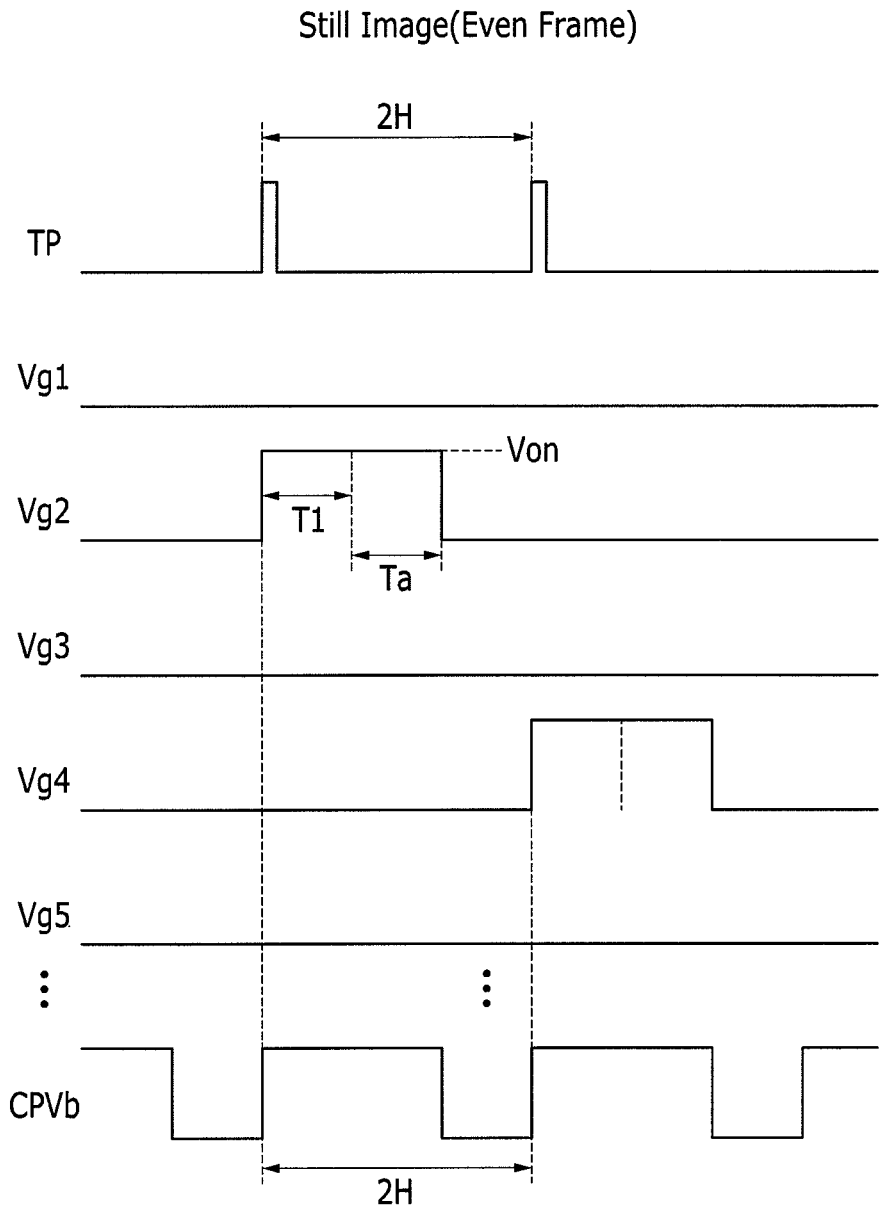
FIG. 28 is a timing diagram of a driving signal in an even numbered frame when a still image is displayed on the display device according to the exemplary embodiment.
Figure 29:
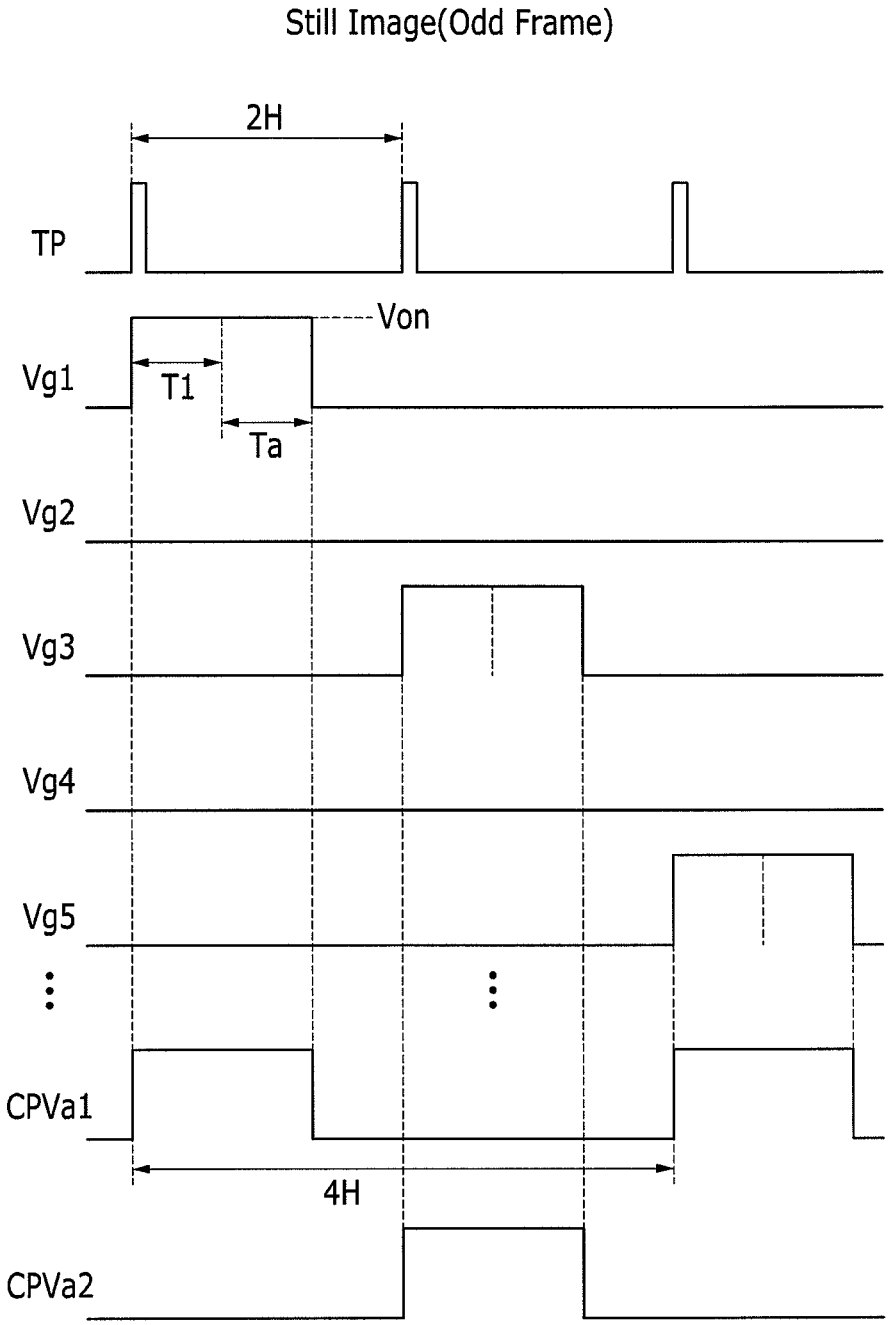
FIG. 29 is a timing diagram of a driving signal in an odd numbered frame when a still image is displayed on the display device according to the exemplary embodiment.
Figure 30:
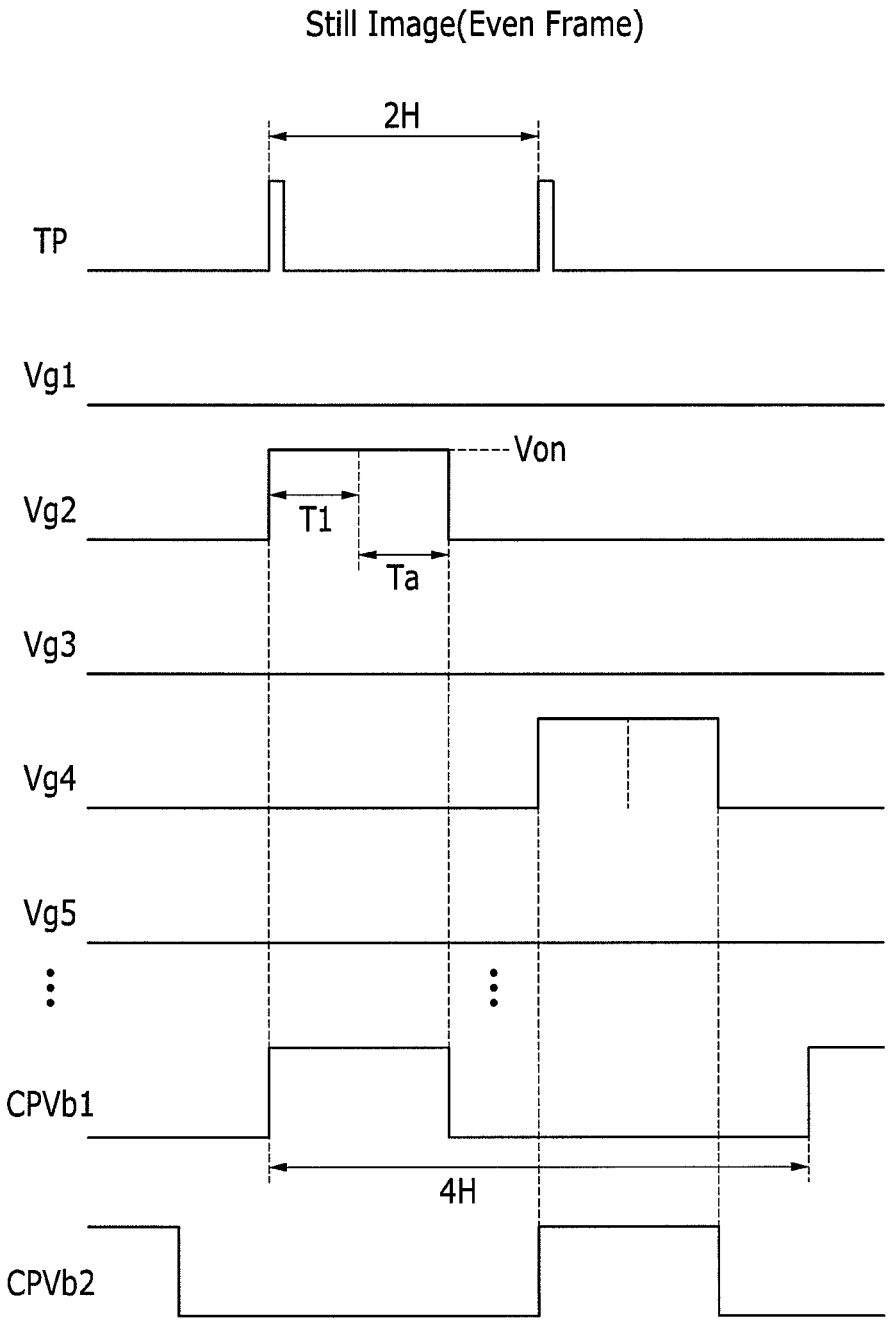
FIG. 30 is a timing diagram of a driving signal in an even numbered frame when a still image is displayed on the display device according to the exemplary embodiment.

FIG. 27 is a timing diagram of a driving signal in an odd numbered frame when a still image is displayed on the display device according to the exemplary embodiment and FIG. 28 is a timing diagram of a driving signal in an even numbered frame when a still image is displayed on the display device according to the exemplary embodiment. FIG. 29 is a timing diagram of a driving signal in an odd numbered frame when a still image is displayed on the display device according to the exemplary embodiment and FIG. 30 is a timing diagram of a driving signal in an even numbered frame when a still image is displayed in the display device according to the exemplary embodiment.

The driving method of the display device according to the exemplary embodiment illustrated in FIGS. 27 to 30 is similar to the exemplary embodiments described above, except a gate clock signal CPV will be described in greater detail.

According to the exemplary embodiment, in the case of displaying a still image, the gate control signal CONT1 may include one gate clock signal CPV, and as illustrated in FIGS. 27 and 28, or may include at least two different gate clock signals CPVa and CPVb which are used when the gate signals Vg1, Vg2, . . . are generated in different frames of one frame set.

In the case of displaying a moving image, the period of a pulse of the gate clock signal is approximately 1 H, and in the case of displaying a still image, the period of a pulse of the gate clock signals CPVa and CPVb may be approximately i times 1 H.

The gate driver 400 may output gate-on voltages Von substantially synchronized with rising edges of the pulses of the gate clock signals CPVa and CPVb, and each gate-on voltage Von may be maintained for a high period of the pulses of the gate clock signals CPVa and CPVb.

FIGS. 27 and 28 illustrate an example in which a pair of gate clock signals CPVa and CPVb are used in the case of displaying a still image, and in this case, the periods of the pulses of the gate clock signals CPVa and CPVb are approximately 2 H.

According to another exemplary embodiment, when the gate control signal CONT1 includes one gate clock signal CPV, the pair of gate clock signals CPVa and CPVb illustrated in FIGS. 27 and 28 may be substantially the same as each other. That is, the pair of gate clock signals CPVa and CPVb may have substantially the same phase.

According to another exemplary embodiment, the gate control signal CONT1 may include at least two gate clock signals having different phases in one frame. In detail, in the case of displaying a moving image, the gate signals may be output alternately substantially synchronized with at least two gate clock signals. In the case of displaying a moving image, in the case where two gate clock signals are used in one frame, the phase difference between the two gate clock signals may be approximately 1 H, and the pulse period of each gate clock signal may be approximately 2 H.

In the case of displaying a still image, as illustrated in FIGS. 29 and 30, the gate control signal CONT1 may include at least two gate clock signals CPVa1 and CPVa2, and CPVb1 and CPVb2 having different phases in one frame. In each frame of one frame set, gate signals Vg1, Vg2, . . . may be output alternately substantially synchronized with one of the at least two gate clock signals CPVa1 and CPVa2, and CPVb1 and CPVb2. As illustrated in FIGS. 29 and 30, when two gate clock signals CPVa1 and CPVa2, and CPVb1 and CPVb2 are used in one frame, the phase difference between the two gate clock signals CPVa1 and CPVa2, and CPVb1 and CPVb2 may be approximately i times 1 H, and the pulse period of each of the gate clock signals CPVa1 and CPVa2, and CPVb1 and CPVb2 may be approximately i times 2 H. Since FIGS. 29 and 30 illustrate an example in which one frame set includes two frames, the pulse period of each of the gate clock signals CPVa1 and CPVa2, and CPVb1 and CPVb2 may be approximately 4 H, and the phase difference between two gate clock signals CPVa1 and CPVa2, and CPVb1 and CPVb2 may be approximately 2 H.

Referring to FIGS. 29 and 30, in the case of displaying a still image in different frames of one frame set, the gate clock signals CPVa1 and CPVa2, and CPVb1 and CPVb2 used when the gate signals Vg1, Vg2, . . . are generated may be substantially the same as each other between frames, or may be different from each other. That is, the phases of the gate clock signals CPVa1 and CPVa2, and CPVb1 and CPVb2 may be substantially the same as each other between frames, or may be different from each other.

Next, the luminance of a display device according to an exemplary embodiment will be described with reference to FIGS. 31 to 34 together with the drawings described above.

Figure 31:
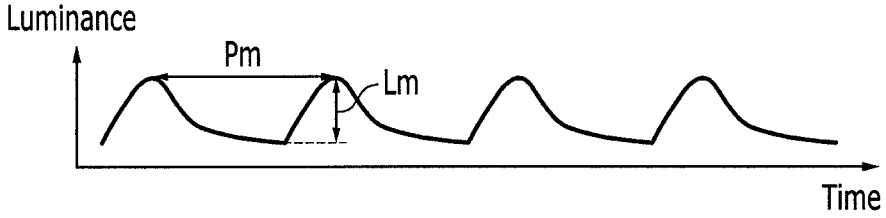
FIG. 31 is a graph illustrating a change in luminance when a moving image is displayed on the display device according to the exemplary embodiment.
Figure 32:
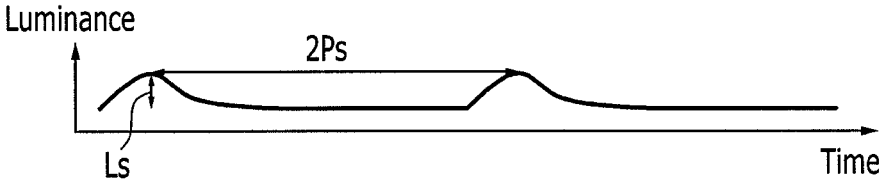
FIG. 32 is a graph illustrating a change in luminance in an odd numbered frame when a still image is displayed on the display device according to the exemplary embodiment.
Figure 33:
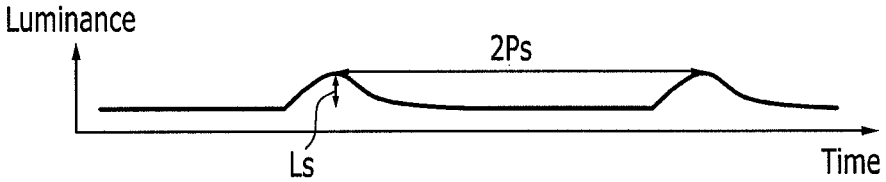
FIG. 33 is a graph illustrating a change in luminance in an even numbered frame when a still image is displayed in the display device according to the exemplary embodiment.
Figure 34:
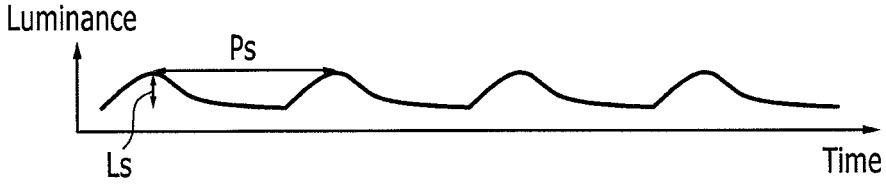
FIG. 34 is a graph illustrating a change in luminance in all frames when a still image is displayed on the display device according to the exemplary embodiment.

FIG. 31 is a graph illustrating a change in luminance when a moving image is displayed on the display device according to the exemplary embodiment and FIG. 32 is a graph illustrating a change in luminance in an odd numbered frame when a still image is displayed on the display device according to the exemplary embodiment. FIG. 33 is a graph illustrating a change in luminance in an even numbered frame when a still image is displayed on the display device according to the exemplary embodiment and FIG. 34 is a graph illustrating a change in luminance in all frames when a still image is displayed on the display device according to the exemplary embodiment.

First, referring to FIG. 31, when the display device according to the exemplary embodiment displays a moving image with a luminance other than black, each pixel PX is charged to the data voltage through the switching element and at this time, luminance of the pixel PX has a peak. Before a charged pixel PX is charged again in the next frame, the charged voltage of the pixel PX is changed due to a leakage current of the switching element, and the luminance may be far away from the peak. In the case of displaying a moving image, since all the pixels PX are periodically charged according to the frame frequency, when the pixel PX is charged in each frame, the change period Pm of the luminance of the pixel PX may be approximately one frame.

Next, referring to FIGS. 32 and 33, a charging method when the display device according to the exemplary embodiment displays a still image with a luminance other than black is similar to that of the case of displaying a moving image, except the pixel rows charged in different frames of one frame set are different from each other. As described above, when one frame set includes i frames, all pixel rows are divided into i pixel row groups which are alternately arranged, and in each frame, the pixel rows of the corresponding pixel row group are sequentially charged. For example, as in the exemplary embodiment illustrated in FIGS. 19 to 22 described above, in an odd numbered frame, odd numbered pixel rows are sequentially charged, and in an even numbered frame, even numbered pixel rows are sequentially charged.

Accordingly, when only one pixel row is viewed, the pixels PX in one pixel row are not charged in each frame, but are charged for every i frames. That is, the change period of the luminance of the pixels PX in one pixel row may be approximately i times one frame. For example, as illustrated in FIGS. 32 and 33, in the case where one frame set includes two frames, the change period of luminance of an even numbered pixel row or odd numbered pixel row may be approximately 2 frames. In the case of displaying a still image, since the pixels PX charged in one frame are approximately (1/i) times all pixels, the change in luminance Ls of the display panel 300 is smaller than the change in luminance Lm of the display panel 300 in the case of displaying a moving image.

However, in the case of displaying a still image, since only some of the pixel rows are charged in every frame, there is a peak luminance of the display panel 300 for each frame. Accordingly, when the display device according to the exemplary embodiment displays a still image with a luminance other than black, the change period Ps of the overall luminance of the display panel 300 may be approximately one frame. That is, the change period Pm of the luminance of the display panel 300 in the case of displaying a moving image may be substantially the same as the change period Ps of the luminance of the display panel 300 in the case of displaying a moving image. For example, as illustrated in FIGS. 32 to 34, a change in luminance illustrated in FIG. 32 is substantially overlapped with a change in luminance illustrated in FIG. 33 for the entire display panel 300 for one frame set in which one image is displayed. As illustrated in FIG. 34, the change period Ps of the luminance of the display panel 300 is approximately a half of the change period of the luminance of each pixel row.

As such, in the case of displaying a still image, all of the pixel rows are distributively charged for a plurality of frames of one frame set, and as a result, the pixels PX are driven at a relatively low frequency, however, the change period Ps of the overall luminance of the display panel 300 may be substantially the same as the change period Pm of the luminance of the display panel 300 in the case of displaying a moving image. Accordingly, even in the case of displaying a still image, a flicker which may occur during low frequency driving may be substantially prevented and thus the image quality may be substantially prevented from deteriorating. Further, referring to FIGS. 31 and 34, the change in luminance Ls in the case of displaying a still image is smaller than the change in luminance Lm in the case of displaying a moving image. Accordingly, the flicker may be further suppressed.

Next, a driving method of a display device according to an exemplary embodiment will be described with reference to FIGS. 35 to 40.

Figure 38:
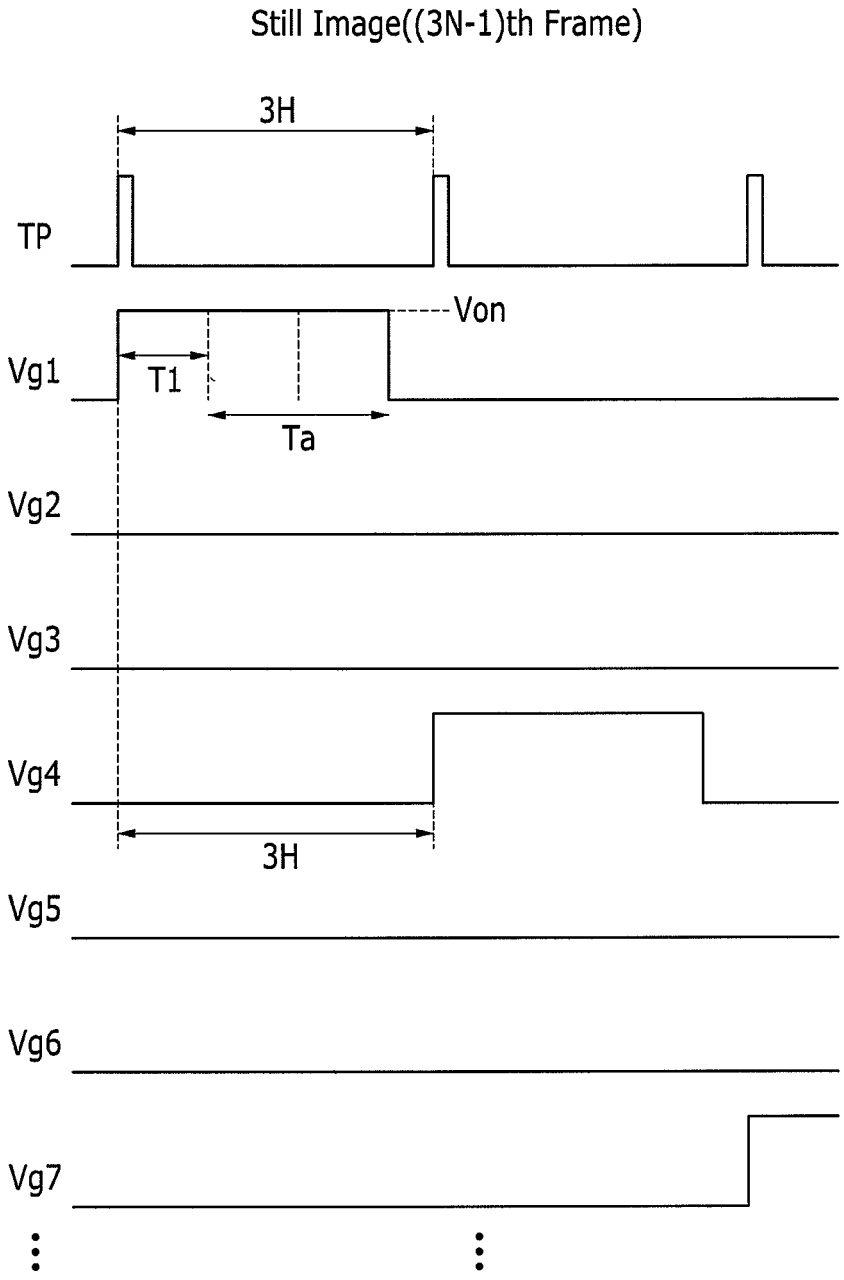
FIG. 38 is a timing diagram of a driving signal in a (3N−1)-th frame (N is a natural number) when a still image is displayed in the display device according to the exemplary embodiment.
Figure 39:
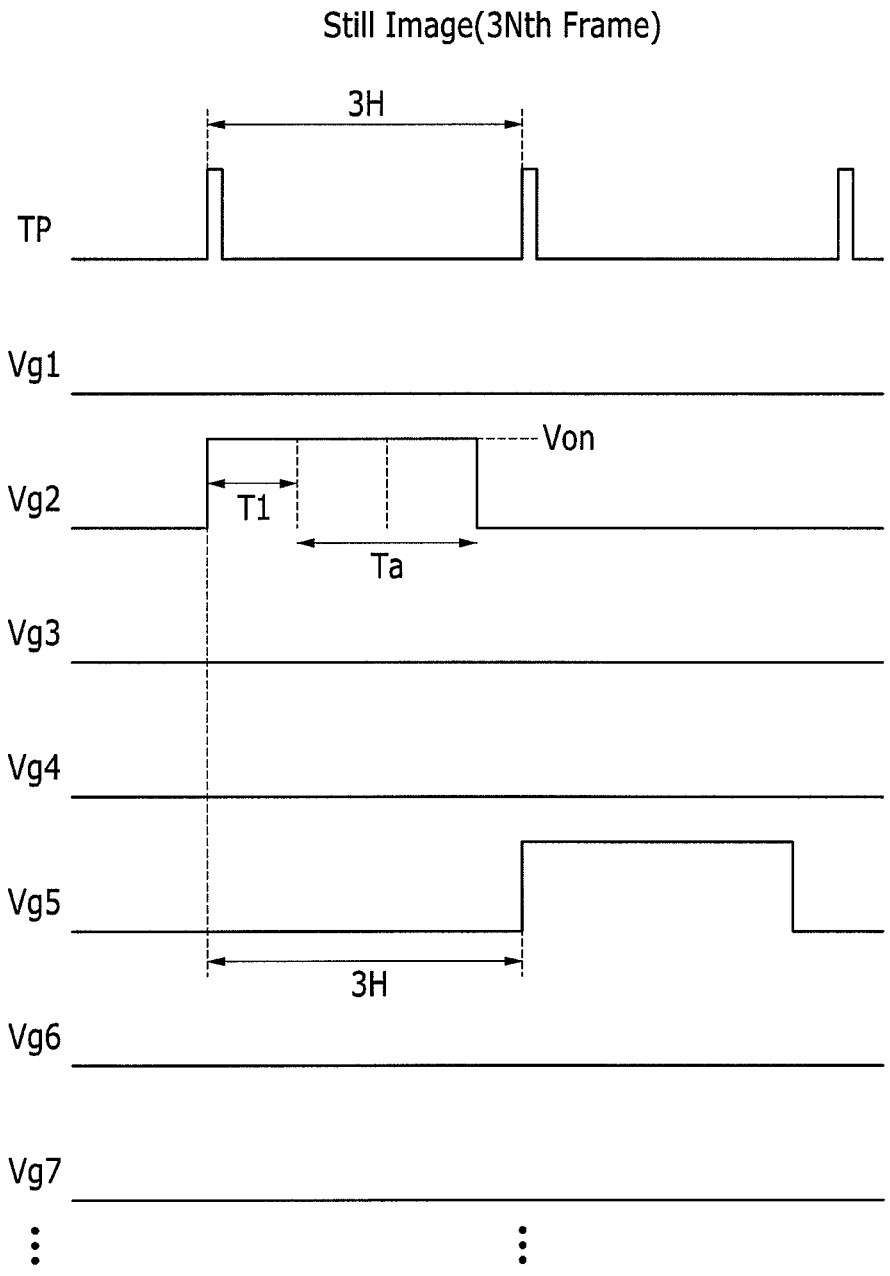
FIG. 39 is a timing diagram of a driving signal in a 3N-th frame (N is a natural number) when a still image is displayed on the display device according to the exemplary embodiment.
Figure 40:
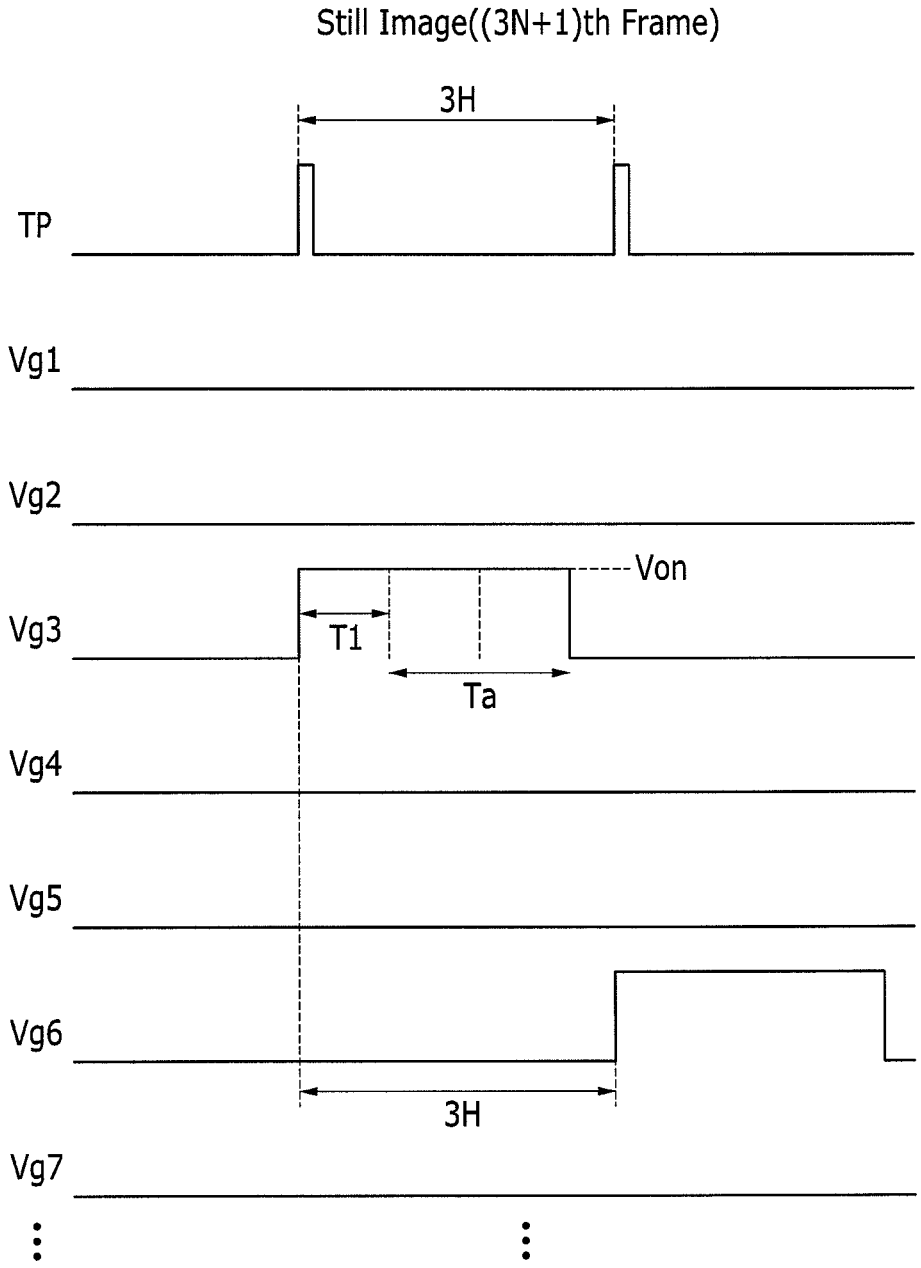
FIG. 40 is a timing diagram of a driving signal in a (3N+1)-th frame (N is a natural number) when a still image is displayed on the display device according to the exemplary embodiment.

FIG. 35 is a diagram illustrating a pixel row charged in a (3N−1)-th frame (N is a natural number) when a still image is displayed on the display device according to the exemplary embodiment, FIG. 36 is a diagram illustrating a pixel row charged in a 3N-th frame (N is a natural number) when a still image is displayed on the display device according to the exemplary embodiment, and FIG. 37 is a diagram illustrating a pixel row charged in a (3N+1)-th frame (N is a natural number) when a still image is displayed on the display device according to the exemplary embodiment. FIG. 38 is a timing diagram of a driving signal in a (3N−1)-th frame (N is a natural number) when a still image is displayed on the display device according to the exemplary embodiment, FIG. 39 is a timing diagram of a driving signal in a 3N-th frame (N is a natural number) when a still image is displayed on the display device according to the exemplary embodiment, and FIG. 40 is a timing diagram of a driving signal in a (3N+1)-th frame (N is a natural number) when a still image is displayed on the display device according to the exemplary embodiment.

The driving method of the display device according to the exemplary embodiment is similar to of the exemplary embodiments described above, but relates to an exemplary embodiment in which one frame set includes three frames (i=3) in the case of displaying a still image.

As a result, for one frame set, data load signals output from the signal controller 600 may be substantially the same as each other, and may include three data load signals TP1, TP2, and TP3 having different phase differences. In this case, the interval between adjacent rising edges of one of the data load signals TP1, TP2, and TP3 may be approximately 3 H. Further, the phase difference among the data load signals TP1, TP2, and TP3 may be approximately 1 H or 2 H.

For each frame of one frame set, any one of the gate lines G1-Gn receives the gate signals Vg1, Vg2, . . . and then the next gate signals Vg1, Vg2, . . . may be applied from the corresponding gate lines G1-Gn. In one frame, the interval between rising edges of gate-on voltages Von of the gate signals Vg1, Vg2, . . . applied to the gate lines G1-Gn which sequentially receive the gate signals Vg1, Vg2, . . . may be approximately 3 H. That is, according to the exemplary embodiment illustrated in FIGS. 35 to 40, in a (3N−1)-th frame (N is a natural number), gate signals Vg1, Vg4, . . . may be sequentially applied to (3N−2)-th gate lines G1, G4, . . . , and in a 3N-th frame, gate signals Vg2, Vg5, . . . may be sequentially applied to (3N−1)-th gate lines G2, G5, . . . , and in a (3N+1)-th frame, gate signals Vg3, Vg6, . . . may be sequentially applied to 3N-th gate lines G3, G6, . . . .

As such, in the case of displaying a still image, in one frame, approximately ⅓ of all the pixels PX may be charged, and one image may be displayed throughout three sequential frames.

According to the exemplary embodiment, in the case of displaying a still image, as illustrated in FIGS. 38 to 40, the length of a period in which the gate-on voltage Von is applied to one of the gate lines G1-Gn, that is, a period in which one pixel PX is charged to the data voltage may be increased by an additional charging time Ta when compared with the first time T1 in the case of displaying a moving image as illustrated in FIG. 17 described above. In the case of displaying a still image, the application time of each gate-on voltage Von including the additional charging time Ta may be increased up to approximately three times the first time T1. When the first time T1 is approximately 1 H, the additional charging time Ta may be approximately 2 H.

Next, the luminance of the display device according to the exemplary embodiment will be described with reference to FIGS. 41 to 45 in addition to FIGS. 35 to 40 described above.

Figure 41:
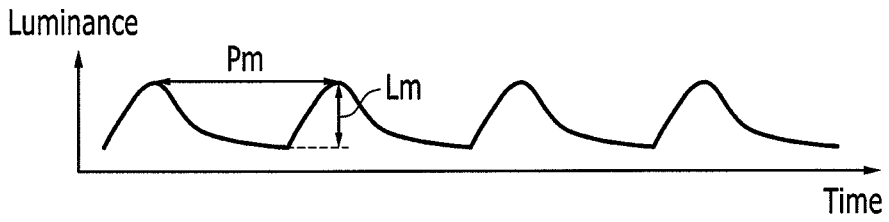
FIG. 41 is a graph illustrating a change in luminance when a moving image is displayed on a display device according to an exemplary embodiment.
Figure 42:
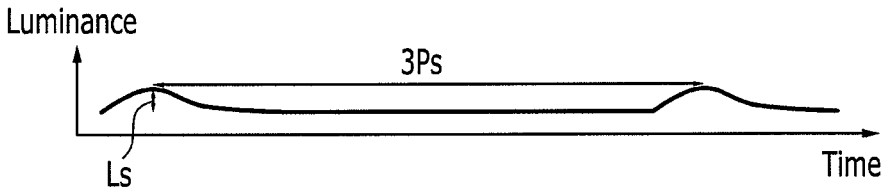
FIG. 42 is a graph illustrating a change in luminance in a (3N−1)-th frame (N is a natural number) when a still image is displayed on the display device according to the exemplary embodiment.
Figure 43:
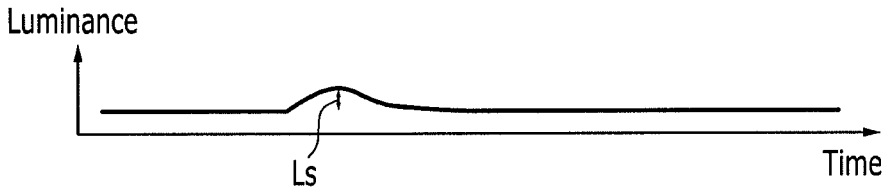
FIG. 43 is a graph illustrating a change in luminance in a 3N-th frame (N is a natural number) when a still image is displayed on the display device according to the exemplary embodiment.
Figure 44:
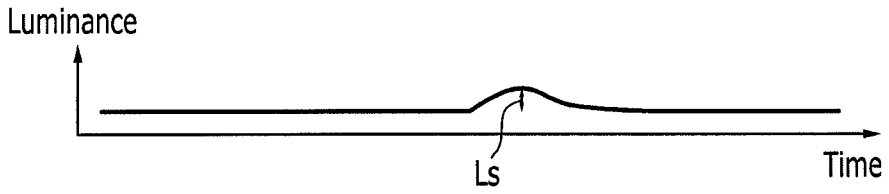
FIG. 44 is a graph illustrating a change in luminance in a (3N+1)-th frame (N is a natural number) when a still image is displayed on the display device according to the exemplary embodiment.
Figure 45:
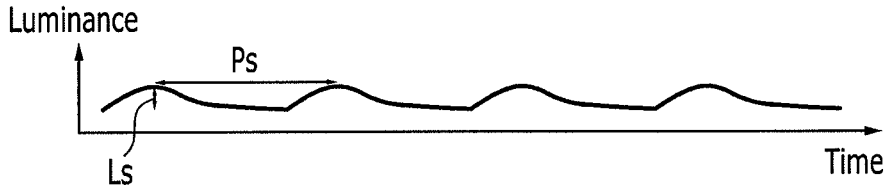
FIG. 45 is a graph illustrating a change in luminance in all frames when a still image is displayed on the display device according to the exemplary embodiment.

FIG. 41 is a graph illustrating a change in luminance when a moving image is displayed on a display device according to an exemplary and FIG. 42 is a graph illustrating a change in luminance in a (3N−1)-th frame (N is a natural number) when a still image is displayed on the display device according to the exemplary embodiment. FIG. 43 is a graph illustrating a change in luminance in a 3N-th frame (N is a natural number) when a still image is displayed on the display device according to the exemplary embodiment and FIG. 44 is a graph illustrating a change in luminance in a (3N+1)-th frame (N is a natural number) when a still image is displayed on the display device according to the exemplary embodiment. FIG. 45 is a graph illustrating a change in luminance in all frames when a still image is displayed in the display device according to the exemplary embodiment.

First, FIG. 41 illustrates a change in luminance of the display panel 300 when the display device according to the exemplary embodiment displays a moving image with a luminance other than black, and may be substantially the same as the exemplary embodiment illustrated in FIG. 31 described above.

Next, referring to FIGS. 42 to 44, a charging method when the display device according to the exemplary embodiment displays a still image with a luminance other than black is similar to that of the case of displaying a moving image, except the pixel rows are charged in different frames of one frame set different from each other as described above. According to the exemplary embodiment, since the pixels PX in one pixel row are not charged in every frame, but are charged for every three frames, a change period in luminance of the pixels PX in one pixel row may be approximately three frames. In the case of displaying a still image, since the number of pixels PX charged in one frame is approximately ⅓ of all the pixels, the change in luminance Ls of the entire display panel 300 is less than a change in luminance Lm in the case of displaying a moving image.

However, in the case of displaying a still image, since at least some pixels are charged for every frame, the overall luminance of the display panel 300 has a peak for every frame, and the change period Ps of the overall luminance of the display panel 300 may be approximately one frame. Accordingly, as illustrated in FIG. 45, the change period Ps of the luminance of the display panel 300 becomes approximately ⅓ of the change period in luminance of each pixel row. As a result, the change period Pm of the luminance of the display panel 300 in the case of displaying a moving image may be substantially the same as the change period Ps of the luminance of the display panel 300 in the case of displaying a still image.

In addition, many features, effects, and the like of the exemplary embodiments described above may be also applied to the exemplary embodiments illustrated in FIGS. 35 to 45.

While the described technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a display panel including a plurality of pixels, a plurality of data lines, and a plurality of gate lines;

a data driver configured to apply a plurality of data voltages to the data lines;

a gate driver configured to apply a plurality of gate signals to the gate lines; and a signal controller configured to control the data driver and the gate driver, wherein the pixels include a first pixel and a second pixel each connected to a first data line, wherein the signal controller includes a plurality of lookup tables corresponding to different pixel rows in the display panel, wherein the lookup tables comprise a first lookup table, wherein the first lookup table stores a correction value of a current input image signal of the first pixel, and wherein the correction value depends at least in part on the current input image signal and a previous input image signal for the second pixel, wherein the second pixel is configured to be charged to a data voltage before the first pixel is charged; and wherein the signal controller is configured to compensate for the current input image signal based at least in part on the correction value.

2. The display device of claim 1, wherein the lookup tables store different correction values according to the distances from the data driver to the pixel positions.

3. The display device of claim 1, wherein the lookup tables store different correction values according to the distances from the gate driver to the pixel positions.

4. The display device of claim 1, wherein the signal controller is configured to i) generate an output image signal based at least in part on the compensated current input image signal and ii) output the output image signal to the data driver, and wherein the data driver is configured to i) generate a data voltage based at least in part on the output image signal and ii) output the data voltage for each 1 horizontal period 1 H.

5. The display device of claim 1, wherein the pixels comprise a plurality of pixel row groups respectively including a plurality of pixel rows, wherein the display panel is configured to display a still image for a frame set including a plurality of sequential frames, wherein the number of pixel row groups is the same as the number of sequential frames, and wherein each of the pixel row groups is configured to be respectively charged to the data voltages for a corresponding frame.

6. The display device of claim 5, wherein the pixel rows are alternately arranged, and wherein adjacent pixel rows belong to different pixel row groups.

7. The display device of claim 5, wherein the signal controller is configured to output a data load signal for a still image to the data driver when the display panel displays the still image, wherein the signal controller is configured to output a data load signal for a moving image to the data driver when the display panel displays the moving image, and wherein a pulse period of the data load signal for the still image is longer than a pulse period of the data load signal for the moving image.

8. The display device of claim 7, wherein the pulse period of the data load signal for the moving image is approximately 1 H, and wherein the pulse period of the data load signal for the still image is approximately an integer multiple of 1 H.

9. The display device of claim 8, wherein the integer multiple of 1 H is equal to the number of pixel row groups.

10. The display device of claim 7, wherein the gate driver is configured to apply i) a first gate signal having a gate-on pulse with a first width when the display panel displays the still image and ii) a second gate signal having a gate-on pulse with a second width less than the first width when the display panel displays the moving image.

11. The display device of claim 1, further comprising:

an image determining unit configured to determine whether an image to be displayed by the display panel is a still image or a moving image.

12. A method of driving a display device including first and second pixels, a first data line, and a plurality of lookup tables, comprising:

receiving a current input image signal for the first pixel;

obtaining a correction value for the current input image signal from one of the lookup tables based at least in part on the current input image signal and a previous input image signal; and compensating for the current input image signal based at least in part on the correction value, wherein the previous input image signal is an input image signal for the second pixel configured to be charged to a data voltage before the first pixel is charged, wherein the first and second pixels are connected to the first data line, wherein the lookup tables correspond to different pixel rows in a display panel.

13. The method of claim 12, wherein the display device includes the display panel and a data driver, and wherein the lookup tables store different correction values according to the distances from the data driver to different pixel positions in the display panel.

14. The method of claim 13, wherein the display device includes a gate driver and wherein the lookup tables store different correction values according to the distances from the gate driver to the pixel positions.

15. The method of claim 12, further comprising:

processing the compensated current input image signal to generate an output image signal;

converting the output image signal into a data voltage; and outputting the data voltage for each 1 H.

16. The method of claim 15, wherein the display device includes the display panel and a plurality of pixels comprising a plurality of pixel row groups respectively including a plurality of pixel rows, the method further comprising:

transferring data voltages for a still image to the display panel for one frame set including a plurality of sequential frames;

transferring gate signals to the display panel for the frame set; and charging the pixel row groups to the data voltages for a corresponding frame.

17. The method of claim 16, wherein the pixel rows are alternately arranged, and wherein adjacent pixel rows belong to different pixel row groups.

18. The method of claim 16, wherein the display device further includes a data driver, the method further comprising:

outputting a data load signal for the still image to the data driver which outputs the data voltage when the display panel displays the still image; and outputting a data load signal for a moving image to the data driver when the display panel displays the moving image, wherein a pulse period of the data load signal for the still image is longer than a pulse period of the data load signal for the moving image.

19. The method of claim 18, wherein the pulse period of the data load signal for the moving image is approximately 1 H, and wherein the pulse period of the data load signal for the still image is an approximately integer multiple of 1 H.

20. The method of claim 16, further comprising:

applying a first gate signal having a gate-on pulse with a first width to the display panel when the display panel displays the still image; and applying a second gate signal having a gate-on pulse with a second width less than the first width to the display panel when the display panel displays the moving image.

21. The method of claim 12, further comprising:

determining whether an image to be displayed by the display panel is a still image or a moving image.

* * * * *